US005403966A

United States Patent [19]

Kawashima et al.

[11] Patent Number: 5,403,966

[45] Date of Patent: Apr. 4, 1995

[54] ELECTRONIC MUSICAL INSTRUMENT WITH TONE GENERATION CONTROL

[75] Inventors: Susumu Kawashima; Nobuhiro Nambu, both of Hamamatsu, Japan

[73] Assignee: Yamaha Corporation, Hamamatsu, Japan

[21] Appl. No.: 39,502

[22] Filed: Mar. 29, 1993

Related U.S. Application Data

[63] Continuation of Ser. No. 460,280, Jan. 2, 1990, abandoned.

[30] Foreign Application Priority Data

| | | | |
|---|---|---|---|
| Jan. 4, 1989 | [JP] | Japan | 64-000867 |
| Jan. 4, 1989 | [JP] | Japan | 64-000869 |
| Jan. 4, 1989 | [JP] | Japan | 64-000870 |
| Jan. 4, 1989 | [JP] | Japan | 64-000871 |
| Jan. 6, 1989 | [JP] | Japan | 1-001855 |

[51] Int. Cl.[6] ..... G10H 7/00; G10H 1/38

[52] U.S. Cl. ..... 84/613; 84/612; 84/637; 84/723; 84/669

[58] Field of Search ..... 83/93, 601, 602, 604, 83/609, 611–613, 615, 618, 626, 631, 644, 634–637, 718, 729, 723, 724, 743, 745, 667–670

[56] References Cited

U.S. PATENT DOCUMENTS

| | | | |
|---|---|---|---|
| 3,954,039 | 5/1976 | Southard | 84/720 |
| 4,342,244 | 8/1982 | Perkins | 84/723 |
| 4,345,501 | 8/1982 | Nakada et al. | 84/612 |
| 4,429,607 | 2/1984 | Meno | 84/DIG. 7 X |
| 4,449,437 | 5/1984 | Cotton, Jr. et al. | 84/613 |
| 4,485,716 | 12/1984 | Koike | 84/609 |
| 4,499,807 | 2/1985 | Ishida | 84/669 |
| 4,526,079 | 7/1985 | Oguri | 84/1.03 |
| 4,630,518 | 12/1986 | Usami | 84/612 |
| 4,674,384 | 6/1987 | Sakurai | 84/626 |
| 4,915,008 | 4/1990 | Sakashita | 84/658 |
| 4,919,030 | 4/1990 | Perron, III | 84/470 R |
| 4,919,032 | 4/1990 | Sakashita | 84/653 |
| 4,939,974 | 7/1990 | Ishida et al. | 84/609 |
| 4,966,052 | 10/1990 | Shiraki | 84/723 |
| 4,993,307 | 2/1991 | Sakashita | 84/615 |
| 5,014,586 | 5/1991 | Sakashita | 84/637 |
| 5,063,820 | 11/1991 | Yamada | 84/609 |
| 5,070,756 | 12/1991 | Abe et al. | 84/631 X |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

This electronic musical instrument, having several sound sources, can generate one tone several times according to tone generation one operation, and generate chord. It can control the tone generation level and tone generation timing based on the instruction input and tempo clock.

26 Claims, 32 Drawing Sheets

| TYP | 1ch | 2ch | 3ch | 4ch | 5ch |
|---|---|---|---|---|---|
| M | 0 | 4 | 7 | 12 | 16 |
| m | 0 | 3 | 7 | 12 | 15 |
| 7 | 0 | 4 | 7 | 10 | 12 |
| m7 | 0 | 3 | 7 | 10 | 12 |

Fig.3(C)

M61

| TYP | ch | TN-ROOT | | | | | |
|---|---|---|---|---|---|---|---|
| | | 0 | 1 | 2 | 3 | 4 | |
| M | 2 | 4 | 4 | 4 | 0 | 0 | |
| | 3 | 0 | 7 | 7 | 7 | 7 | |
| | 4 | 7 | 1 | 2 | 4 | 4 | |
| | 5 | 4 | 0 | 0 | 3 | 0 | |
| m | 2 | 3 | 3 | 3 | 0 | 0 | |
| | 3 | 0 | 7 | 7 | 7 | 7 | |
| | 4 | 7 | 1 | 2 | 3 | 3 | |
| | 5 | 3 | 0 | 0 | 0 | 4 | |
| 7 | 2 | 10 | 10 | 10 | 10 | 10 | |
| | 3 | 4 | 4 | 4 | 7 | 4 | |
| | 4 | 0 | 7 | 7 | 3 | 0 | |
| | 5 | 7 | 0 | 0 | 4 | 7 | |
| m7 | 2 | 10 | 10 | 10 | 10 | 10 | |
| | 3 | 3 | 3 | 3 | 3 | 7 | |
| | 4 | 0 | 7 | 7 | 0 | 4 | |
| | 5 | 7 | 0 | 0 | 7 | 3 | |

M60

Fig.3(D)

| | |
|---|---|
| BV min | Max.sensor voltage |
| BV max | Min. sensor vlotage |
| BD0 | Standard breath intensity data |
| R0 | Preset coefficient |

Fig.4(A)

EPR

| key \ i | 0 | 1 | 2 | 3 | 4 | 5 | 6 | 7 | 8 | 9 | 10 | 11 | 12 | 13 | 14 | 15 | 16 | 17 | 18 | 19 | 20 | 21 |
|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 5 | 1 | 1 | 1 | 1 | 1 | 1 | 1 | 1 | 1 | 1 | 1 | 1 | 1 | 1 | 1 | 1 | 1 | 1 | 0 | 0 | 0 | 0 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 1 | 1 | 1 | 1 | 0 | 0 | 0 | 0 | 0 | 0 | 0 | 1 | 1 | 1 | 1 |
| 10 | 1 | 1 | 1 | 1 | 1 | 1 | 1 | 1 | 0 | 0 | 0 | 1 | 1 | 1 | 1 | 1 | 1 | 0 | 1 | 1 | 1 | 1 |
| 11 | 1 | 0 | 1 | 0 | 1 | 0 | 1 | 0 | 0 | 1 | 0 | 1 | 0 | 1 | 0 | 1 | 0 | 0 | 1 | 0 | 1 | 0 |
| 12 | 1 | 1 | 1 | 1 | 1 | 1 | 0 | 0 | 0 | 1 | 1 | 1 | 1 | 1 | 1 | 1 | 1 | 0 | 0 | 0 | 1 | 1 |
| 13 | 1 | 1 | 1 | 1 | 0 | 0 | 0 | 0 | 0 | 1 | 1 | 0 | 0 | 1 | 1 | 1 | 1 | 0 | 0 | 0 | 0 | 0 |
| 14 | 1 | 1 | 0 | 0 | 0 | 0 | 0 | 0 | 0 | 1 | 1 | 0 | 0 | 1 | 1 | 0 | 0 | 0 | 0 | 0 | 0 | 0 |

| key \ i | 22 | 23 | 24 | 25 | 26 | 27 | 28 | 29 | 30 | 31 | 32 | 33 | 34 | 35 | 36 | 37 | 38 | 39 | 40 | 41 | 42 | 43 |
|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 1 | 1 | 1 | 1 | 1 | 1 | 1 | 1 | 1 | 0 | 0 | 0 | 0 | 0 | 0 | 0 | 1 | 0 | 0 | 0 | 0 |
| 2 | 1 | 1 | 1 | 1 | 0 | 0 | 0 | 1 | 0 | 0 | 1 | 1 | 1 | 1 | 0 | 0 | 0 | 0 | 0 | 0 | 0 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 1 | 0 | 0 | 0 | 1 | 1 | 1 | 0 | 1 | 1 | 1 | 0 | 0 | 0 | 1 | 1 | 1 | 0 | 1 | 1 | 1 | 1 |
| 5 | 0 | 1 | 1 | 1 | 1 | 1 | 1 | 0 | 1 | 0 | 0 | 1 | 1 | 1 | 1 | 1 | 1 | 0 | 0 | 1 | 1 | 1 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 0 | 1 | 0 | 0 | 1 | 1 | 1 | 0 | 0 | 0 | 0 | 1 | 0 | 0 | 1 | 1 | 1 | 0 | 0 | 1 | 1 | 1 |
| 10 | 0 | 0 | 1 | 1 | 0 | 0 | 0 | 0 | 0 | 0 | 0 | 0 | 1 | 1 | 0 | 0 | 0 | 0 | 0 | 1 | 1 | 1 |
| 11 | 0 | 0 | 1 | 0 | 0 | 1 | 0 | 0 | 0 | 0 | 0 | 0 | 1 | 0 | 0 | 1 | 0 | 0 | 0 | 1 | 0 | 1 |
| 12 | 0 | 0 | 1 | 1 | 0 | 1 | 1 | 0 | 0 | 0 | 0 | 0 | 1 | 1 | 0 | 1 | 1 | 0 | 0 | 1 | 1 | 1 |
| 13 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 14 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

Fig.4(B)

EPR

| key \ i | 44 | 45 | 46 | 47 | 48 | 49 | 50 | 51 | 52 | 53 | 54 | 55 | 56 | 57 | 58 | 59 | 60 | 61 | 62 | 63 | 64 | 65 |
|---|---|---|---|---|---|---|---|---|---|---|---|---|---|---|---|---|---|---|---|---|---|---|
| 0 | 0 | 1 | 0 | 0 | 1 | 1 | 1 | 1 | 1 | 1 | 1 | 1 | 1 | 1 | 1 | 1 | 1 | 1 | 1 | 1 | 1 | 1 |
| 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 0 | 1 | 1 | 1 | 1 | 1 | 1 | 1 | 1 | 1 | 1 | 1 | 1 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 1 | 1 | 1 | 1 | 1 | 1 | 1 | 1 | 1 | 1 | 1 | 1 | 1 | 1 | 1 | 1 | 1 | 1 | 1 | 0 | 0 | 0 |
| 5 | 1 | 1 | 1 | 1 | 1 | 1 | 1 | 1 | 1 | 1 | 0 | 1 | 1 | 0 | 0 | 0 | 0 | 0 | 0 | 0 | 1 | 1 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 0 | 0 | 0 | 1 | 0 | 0 | 0 | 1 | 1 | 0 | 0 | 1 | 1 | 1 | 1 |
| 10 | 1 | 1 | 1 | 1 | 0 | 0 | 0 | 1 | 1 | 0 | 0 | 1 | 1 | 0 | 1 | 1 | 1 | 1 | 1 | 1 | 1 | 0 |
| 11 | 0 | 0 | 0 | 0 | 1 | 0 | 0 | 0 | 0 | 0 | 0 | 1 | 0 | 0 | 1 | 0 | 1 | 0 | 0 | 0 | 0 | 1 |
| 12 | 1 | 0 | 0 | 0 | 1 | 1 | 0 | 0 | 0 | 0 | 0 | 1 | 1 | 0 | 1 | 1 | 1 | 1 | 0 | 0 | 0 | 1 |
| 13 | 0 | 0 | 0 | 0 | 0 | 0 | 0 | 0 | 1 | 0 | 0 | 1 | 1 | 0 | 0 | 0 | 0 | 0 | 0 | 0 | 1 | 1 |
| 14 | 0 | 0 | 0 | 0 | 0 | 0 | 0 | 0 | 1 | 0 | 0 | 1 | 1 | 0 | 0 | 0 | 0 | 0 | 0 | 0 | 1 | 1 |

| key \ i | 66 | 67 | 68 | 69 | 70 | 71 | 72 | 73 | 74 | 75 | 76 | 77 | 78 | 79 | 80 | 81 | 82 | 83 | 84 | 85 | 86 | 87 |
|---|---|---|---|---|---|---|---|---|---|---|---|---|---|---|---|---|---|---|---|---|---|---|
| 0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 1 | 1 | 1 | 1 | 1 | 1 | 1 | 1 | 0 | 0 | 0 | 0 | 0 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 0 | 1 | 1 | 0 | 0 | 0 | 0 | 0 | 0 | 0 | 0 | 1 | 1 | 1 | 1 | 1 | 1 | 1 | 1 | 1 | 1 | 0 |
| 5 | 1 | 1 | 1 | 1 | 1 | 1 | 1 | 1 | 1 | 1 | 1 | 1 | 1 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 0 | 0 | 0 | 0 | 0 | 0 | 0 | 0 | 0 | 1 | 1 | 1 | 1 | 1 | 1 |
| 10 | 0 | 1 | 1 | 0 | 0 | 0 | 0 | 0 | 0 | 0 | 0 | 1 | 1 | 1 | 1 | 0 | 1 | 1 | 0 | 0 | 1 | 0 |
| 11 | 0 | 1 | 0 | 1 | 0 | 1 | 0 | 1 | 0 | 1 | 0 | 1 | 0 | 1 | 1 | 0 | 1 | 0 | 1 | 0 | 0 | 0 |
| 12 | 1 | 1 | 1 | 1 | 1 | 1 | 1 | 1 | 1 | 1 | 1 | 1 | 1 | 1 | 1 | 0 | 1 | 1 | 1 | 1 | 0 | 0 |
| 13 | 1 | 1 | 1 | 0 | 0 | 1 | 1 | 1 | 1 | 0 | 0 | 0 | 0 | 0 | 0 | 0 | 1 | 1 | 0 | 0 | 0 | 0 |
| 14 | 1 | 1 | 1 | 0 | 0 | 0 | 0 | 1 | 1 | 0 | 0 | 0 | 0 | 0 | 0 | 0 | 1 | 1 | 0 | 0 | 0 | 0 |

Fig.4(C)

FPS

| key \ i | 0 | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 1 | 1 | 1 | 1 | 1 | 1 | 1 | 1 | 1 | 1 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 |
| 4 | 1 | 1 | 1 | 1 | 1 | 1 | 1 | 1 | 1 | 1 | 1 | 1 | 1 | 1 | 1 | 1 | 1 | 1 | 1 |
| 5 | 1 | 1 | 1 | 1 | 1 | 1 | 1 | 1 | 1 | 1 | 1 | 1 | 1 | 1 | 1 | 1 | 1 | 1 | 1 |
| 6 | 0 | 0 | 0 | 0 | 1 | 0 | 1 | 0 | 1 | 0 | 1 | 0 | 1 | 0 | 1 | 0 | 0 | 0 | 1 |
| 7 | 1 | 1 | 1 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 1 | 1 | 1 | 1 | 1 | 1 | 1 | 1 | 1 | 0 | 0 | 0 |
| 10 | 1 | 1 | 1 | 1 | 1 | 1 | 1 | 1 | 1 | 1 | 1 | 0 | 0 | 0 | 0 | 0 | 1 | 0 | 1 |
| 11 | 0 | 0 | 0 | 0 | 0 | 0 | 0 | 0 | 0 | 0 | 0 | 0 | 0 | 0 | 0 | 0 | 0 | 0 | 0 |
| 12 | 1 | 1 | 1 | 1 | 1 | 1 | 1 | 1 | 1 | 0 | 0 | 0 | 0 | 1 | 1 | 1 | 0 | 1 | 0 |
| 13 | 1 | 1 | 0 | 0 | 0 | 0 | 0 | 1 | 1 | 0 | 0 | 0 | 0 | 0 | 0 | 0 | 0 | 0 | 0 |
| 14 | 1 | 0 | 1 | 1 | 1 | 0 | 0 | 0 | 0 | 0 | 0 | 0 | 0 | 0 | 0 | 1 | 0 | 0 | 0 |

| key \ i | 19 | 20 | 21 | 22 | 23 | 24 | 25 | 26 | 27 | 28 | 29 | 30 | 31 | 32 | 33 | 34 | 35 | 36 | 37 |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 1 | 1 | 1 | 1 | 1 | 1 | 1 | 1 | 1 | 1 | 0 | 1 | 0 | 0 | 0 | 0 |
| 3 | 0 | 0 | 0 | 0 | 0 | 0 | 0 | 0 | 1 | 0 | 0 | 0 | 0 | 0 | 0 | 0 | 0 | 0 | 0 |
| 4 | 1 | 1 | 1 | 1 | 1 | 1 | 1 | 1 | 0 | 0 | 0 | 0 | 0 | 1 | 0 | 1 | 1 | 0 | 1 |
| 5 | 1 | 1 | 1 | 1 | 1 | 0 | 0 | 0 | 0 | 0 | 0 | 0 | 1 | 1 | 0 | 1 | 0 | 0 | 0 |
| 6 | 1 | 0 | 0 | 0 | 1 | 0 | 0 | 0 | 0 | 0 | 0 | 0 | 0 | 0 | 0 | 0 | 0 | 0 | 1 |
| 7 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 |
| 9 | 0 | 0 | 0 | 0 | 0 | 1 | 1 | 0 | 0 | 1 | 0 | 0 | 1 | 1 | 0 | 0 | 0 | 0 | 0 |
| 10 | 0 | 1 | 1 | 0 | 0 | 1 | 1 | 0 | 0 | 0 | 1 | 0 | 0 | 0 | 0 | 0 | 0 | 0 | 0 |
| 11 | 0 | 0 | 0 | 0 | 0 | 0 | 0 | 0 | 0 | 0 | 0 | 0 | 0 | 0 | 0 | 0 | 0 | 0 | 0 |
| 12 | 1 | 1 | 1 | 0 | 0 | 0 | 1 | 0 | 0 | 0 | 0 | 1 | 0 | 0 | 0 | 0 | 0 | 0 | 0 |
| 13 | 0 | 0 | 0 | 0 | 0 | 0 | 0 | 0 | 0 | 0 | 0 | 0 | 0 | 0 | 0 | 0 | 0 | 0 | 0 |
| 14 | 0 | 0 | 1 | 0 | 0 | 0 | 0 | 0 | 0 | 0 | 0 | 0 | 0 | 0 | 0 | 0 | 0 | 0 | 0 |

Fig.4(D)

TNK

| i | TN |
|---|---|
| 0 | 0 |
| 1 | 0 |
| 2 | 1 |
| 3 | 1 |
| 4 | 2 |
| 5 | 2 |
| 6 | 3 |
| 7 | 4 |
| 8 | 5 |
| 9 | 5 |
| 10 | 5 |
| 11 | 6 |
| 12 | 6 |
| 13 | 6 |
| 14 | 6 |
| 15 | 6 |
| 16 | 6 |
| 17 | 7 |
| 18 | 8 |
| 19 | 8 |
| 20 | 8 |
| 21 | 8 |
| 22 | 9 |
| 23 | 10 |
| 24 | 10 |
| 25 | 10 |
| 26 | 10 |
| 27 | 10 |
| 28 | 10 |
| 29 | 11 |
| 30 | 11 |
| 31 | 12 |
| 32 | 13 |
| 33 | 13 |
| 34 | 13 |
| 35 | 13 |
| 36 | 13 |
| 37 | 13 |
| 38 | 13 |
| 39 | 13 |
| 40 | 14 |
| 41 | 15 |
| 42 | 15 |
| 43 | 15 |
| 44 | 15 |

| i | TN |
|---|---|
| 45 | 16 |
| 46 | 16 |
| 47 | 16 |
| 48 | 17 |
| 49 | 17 |
| 50 | 17 |
| 51 | 18 |
| 52 | 18 |
| 53 | 19 |
| 54 | 20 |
| 55 | 20 |
| 56 | 20 |
| 57 | 21 |
| 58 | 22 |
| 59 | 22 |
| 60 | 22 |
| 61 | 22 |
| 62 | 23 |
| 63 | 24 |
| 64 | 25 |
| 65 | 25 |
| 66 | 25 |
| 67 | 25 |
| 68 | 25 |
| 69 | 26 |
| 70 | 26 |
| 71 | 26 |
| 72 | 26 |
| 73 | 27 |
| 74 | 27 |
| 75 | 27 |
| 76 | 27 |
| 77 | 27 |
| 78 | 27 |
| 79 | 28 |
| 80 | 28 |
| 81 | 28 |
| 82 | 29 |
| 83 | 29 |
| 84 | 30 |
| 85 | 30 |
| 86 | 30 |
| 87 | 31 |

Fig.4(E)

TNS

| i | TN | TN |
|---|---|---|
| 0 | 0 | -2 |
| 1 | 0 | -2 |
| 2 | 1 | -1 |
| 3 | 2 | 0 |
| 4 | 3 | 1 |
| 5 | 4 | 2 |
| 6 | 4 | 2 |
| 7 | 5 | 3 |
| 8 | 5 | 3 |
| 9 | 6 | 4 |
| 10 | 6 | 4 |
| 11 | 7 | 5 |
| 12 | 7 | 5 |
| 13 | 7 | 5 |
| 14 | 7 | 5 |
| 15 | 7 | 5 |
| 16 | 8 | 6 |
| 17 | 8 | 6 |
| 18 | 8 | 6 |
| 19 | 8 | 6 |
| 20 | 8 | 6 |
| 21 | 8 | 6 |
| 22 | 9 | 7 |
| 23 | 10 | 8 |
| 24 | 10 | 8 |
| 25 | 10 | 8 |
| 26 | 11 | 9 |
| 27 | 12 | 10 |
| 28 | 12 | 10 |
| 29 | 12 | 10 |
| 30 | 12 | 10 |
| 31 | 12 | 10 |
| 32 | 12 | 10 |
| 33 | 13 | 11 |
| 34 | 13 | 11 |
| 35 | 14 | 12 |
| 36 | 15 | 13 |
| 37 | 15 | 13 |

Fig.7(A)

| | |
|---|---|
| A | Sequence pointer |
| B | 1-beat clock register |
| BD | Breath intensity data buffer |
| BF | Breath ON flag |
| BEET | Beat number counter |
| BRTH1/2/3 | Breath intensity register |
| BUF,BUFA,BUFB | Fingering pattern buffer |
| BV | Breath sensor voltage buffer |
| CSR | Chord sequence record flag |
| FM | Fingering mode flag |
| INIT | Initial intensity register |
| LTH | Chord length register |
| MODE | Mode register |
| PH | Peak hold flag |
| R | Conversion coefficient register |
| RITH | Rhythm pattern register |
| ROOT | Root register |
| RP | Rhythm pattern No. register |
| RSV | Reserve flag |
| RUN | RUN flag |
| T | Clock counter |
| TC | Tone color No. register |
| TEMP | Tempo register |
| TYP | Chord type register |

Fig.7(B)

| ch | KON | T N |
|---|---|---|
| 1 | | |
| 2 | | |
| 3 | | |
| 4 | | |
| 5 | | |

Fig.7(C)

| A | ROOT | TYP | LTH |
|---|---|---|---|
| 0 | C | M | 4 |
| 1 | A | m | 4 |
| | ⋮ | ⋮ | ⋮ |

(A):Main routine (D):Tone color
selection subroutine (E):Playing mode setting subroutine (F):Fingering mode switching subroutine (G):Rhythm setting subroutine (H):Start/stop subroutine (I):Melody mode subroutine (J):Pitch detecting subroutine (K):Auto chord subroutine (M):Chord detecting subroutine (N):Chord sequence
record subroutine (O):Rhythm interruption (Q):Breath interruption

ELECTRONIC MUSICAL INSTRUMENT WITH TONE GENERATION CONTROL

This is a continuation of application Ser. No. 07/460,280, filed on Jan. 2, 1990, now abandoned.

BACKGROUND OF THE INVENTION

1. Field of the Invention

This invention relates to an electronic musical instrument which can generate several tones simultaneously or which can generate specified chords.

2. Description of the Prior Art

At present available are various electronic musical instruments which can generate several tones simultaneously, generate specified chords, or generate automatically rhythm. Also available are instruments which can control the tone generation level by detecting the key depression speed and breath intensity.

These musical instruments have the following functions and faults.

The electronic musical instruments which can generate simultaneously several tones, in general, have some sound source circuits, and the number of musical tones which can be generated simultaneously by one sound generation operation (pressing of keyboard).can be changed. This is enabled by setting beforehand the number of sound sources actuated by one sound generation operation (hereinafter referred to as the number of sound sources) in the electronic musical instrument. However, since the setting of the number of sound sources requires operations of various function keys, it is impossible to do such a setting during playing the instrument. The conventional electronic musical instruments had faults that when the number of sound sources is set to 1, only one musical tone is generated, thereby resulting in poor expression, even though the specified tone is ff(fortissimo), and that when the number of sound sources is set to 2 or more (generally 2 to 8), the sound is heavy and lacks in delicacy, even if the specified tone is pp (pianissimo). Besides, there are other types of electronic musical instruments which allow programming of various types of settings of the sound sources and enable program selection with a simple selection operation. However, this type needs the program change operation, and the program selection can be performed only in a previously specified order. Correct execution of such a program needs training of player to some extent. Accordingly, for beginners this was difficult. Moreover, it was very difficult to change quickly the number of sound sources of the conventional electronic musical instruments during playing, following the change of volume (level).

The electronic musical instruments capable of generating chords generate chords by specifying the root (the lowest tone in a chord (for example, C in the do-mi-so)) and the type (major chord, minor chord, dominant seventh chord, dominant seventh minor chord). For example, keyboard type electronic musical instruments have the following functions.

Pressing one key generates the major chord whose root is the pressed key.

Pressing two keys generates the minor chord whose root is the higher key.

Pressing three keys generates the dominant seventh chord whose root is the highest key.

However, in these electronic musical instruments the data which can be specified are only the root and type of chord, therefore only the specific chord can be generated by one specification. Accordingly, the player cannot give variation of the sound (strong and weak sound), and the music is monotonous. When the player wants, for example, to express a pianissimo tone, a chord consisting of 3 to 5 tones is generated, so that delicacy is lost.

The electronic musical instruments which can generate rhythm incorporate a rhythm generating section. These instruments can generate various rhythms by setting the type of rhythm and tempo. In the electronic musical instruments having an automatic accompaniment function a chord specified by keyboard can be generated as broken chord (arpeggio) based on the rhythm tempo. However, the conventional automatic accompaniment function could only generate one or several tones according to the rhythm tempo, decomposing the specified chord into component sound tones. Therefore, if the player changes the chord during beat, with improper timing, the chord is changed while the broken chord is being generated. For example, when a chord is a sextuplet (one beat) consisting of prime, third, fifth, octave, fifth, and third, and the tonic chord(C chord) is specified, the chord must be generated in the order of "do, mi, sol, do, sol, mi". But, if the specification is changed to the D chord at the next timing to the octave tone generating while a broken chord is generated, the chord generated is "do, mi, sol, do, la, fa#". Thereby a complicated chord is generated. So as to eliminate this failure, the player has to change the chord according to beat timing. Accordingly, playing such an instrument is difficult. The same is valid not only while playing chords, but also while playing a melody in tune with a rhythm.

There are two types of electronic musical instruments which can control the tone generation level. One of them is keyboard type electronic instruments having a function to control the musical tone intensity (tone generation level) by detecting the key depression intensity and speed. Another type is electronic wind instrument which controls the tone generation level by detecting the breath intensity. These electronic instruments are provided with a sensor to detect the abovementioned intensity (key depression and breath intensity) and a means for converting the detected value into the tone generation level control data. However, the conventional electronic instrument has a defect that the tone generation level varies depending on the player's key depressing force or breath intensity because the detected values are converted into the tone generation level control data always based on a fixed relation. Hence, if an instrument is played by a player with higher key depression intensity or breath intensity, the sensor detection value reaches soon the level of "ff", and he can not play delicately. On the other hand, for a player with lower key depression intensity or breath intensity it is difficult to generate sound of sufficient level (breath threshold). The electronic wind instruments are provided with a breath sensor as shown in FIG. 1 (C). However, it is difficult to uniform their characteristics owing to their structural features, therefore, they differ in the relation between actual breath intensity and tone generation level.

Among all electronic instruments, the electronic wind instruments, in general, have a form and a key arrangement similar to those of woodwind instruments. They are designed so that a specific sound pitch can be specified by setting a playing key to ON or OFF with a fingering pattern similar to that of the woodwind instruments. However, since the actual wind instruments are monophonic instruments, the above-mentioned fingering pattern is set so as to specify a specific single tone. Therefore, most of conventional electronic wind instruments can not specify chords and can generate only single tones. This makes it difficult to use them for accompaniment.

Summary of the Invention

In brief, my invention contemplates an electronic musical instrument described below, to be realized with due regard to the above-mentioned conventional technologies.

An electronic musical instrument which can change the number of tone sources according to a level control input.

An electronic musical instrument which can change the number of tone generation parts of a chord according to a level control input An electronic musical instrument which can correct specification deviation of timing of tone generation or switching of chords and match timing to beat timing.

An electronic musical instrument which can scale arbitrarily a relation between key depression speed or breath intensity and tone generation level.

An electronic musical instrument which can specify and generate chords and switch the fingering for usual melody generation and chord generation. As a result of realization of such an electronic musical instrument the following becomes possible.

Since the number of sources of tones to be generated simultaneously can be increased or decreased by tone generation level control input, several tones can be generated simultaneously to express heavy tone, when the tone generation level is high, but when the tone generation level is low, a delicate tone can be expressed by one sound. This control can be performed automatically without previous programming or special operation (program change), thereby simplifying the play of instrument and enabling beginners to play expressively, Since the number of parts of chord which must be generated simultaneously can be increased or decreased by the tone generation level control input, dignified tones, covering the wide range of tones from low-pitched tone to high-pitched tone, can be generated by generating simultaneously many parts, if the tone generation level is high. If the tone generation level is low, delicate tone can be generated with one or two tones. This control can be performed by simpler operation as compared to the general keyboard operation, thereby enabling the beginners to play expressively, Even if tone generation specification is deviated from the beat timing, the tone generation is controlled depending on deviation so that the specified tone is generated at once or it is generated after the next beat timing. If the specification is delayed insignificantly (delayed specification), tone is generated immediately, but if the specification is delayed significantly or given just before the next beat (early specification), tone is generated at the next beat timing. Owing to this control the player needs not pay much attention to the beat timing, therefore, even beginners can easily play the instrument with a proper rhythm.

Since the specific reference tone generation level can be set according to the player's operation data (key depression speed or breath intensity) and the subsequent tone generation level can be controlled according to the relation between the player's operation data and tone generation level, even those players (children or women) who cannot depress or blow in strongly are able to perform fortissimo. Those players who are apt to strongly depress the keys or blow in can perform piano. Thus, every player can cover widely a dynamic range. The dispersion of characteristics of sensors of musical instruments can be canceled by this setting, which is also an advantage.

Since it is possible to specify the types of chord by using a part of playing keys of electronic musical instrument, such as octave key, and to specify a root by using another key (key provided at front side of wind instrument), a chord can be specified by the key system of the wind instrument, and thereby the chord generation means is realized, so that the electronic wind instruments can generate chord, resulting in possibility of use of wind instruments for chord accompaniment. This is another advantage. Moreover, an electronic musical instrument is provided with a means for selecting the chord specification means and the single tone specification means, so that the instrument can be used as a melody instrument or as accompaniment instrument. Accordingly, the application of electronic wind instruments can be widened.

BRIEF DESCRIPTION OF THE DRAWINGS

FIG. 1 (C) is a cross-section view in the vicinity of a mouthpiece of the electronic wind instrument.

FIGS. 4 (A) to (E) show key pattern, table and tone number table set in a ROM.

FIGS. 7 (A) to (C) show a configuration of a RAM incorporated in a microcomputer of control section.

FIG. 8 (A) shows a main routine. FIG. 8. (B) ,and FIG. 8 (C) show the operations of breath trimming. FIGS. 8 (D) to (H) show subroutine, FIGS. 8 (I) to (N) show subroutine relating to switch operations, FIG. 8 (0) and Fig. 8 (P) show a rhythm interruption operation, and FIG. 8 (Q) shows a breath interruption operation.

DESCRIPTION OF THE PREFERRED EMBODIMENT (Explanation of composition )

Figure 1A:
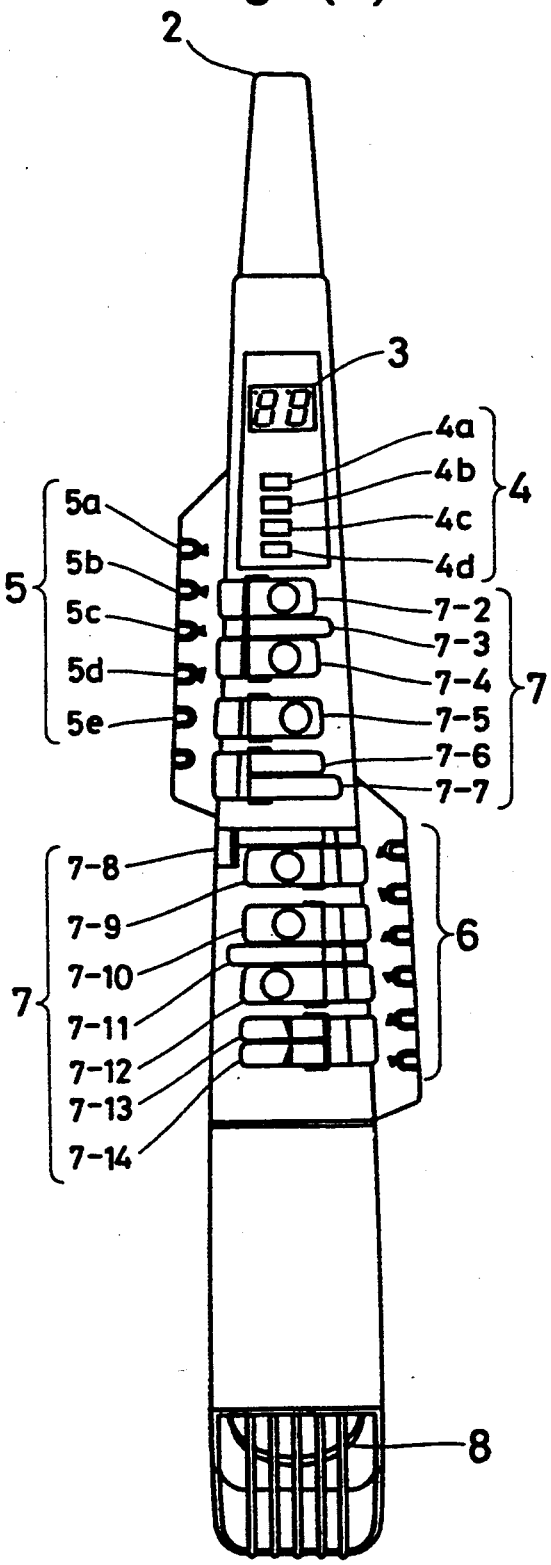
FIG. 1 (A) and FIG. 1 (B) show an appearance of an electronic wind instrument which is an example of embodiment of this invention.
Figure 1B:
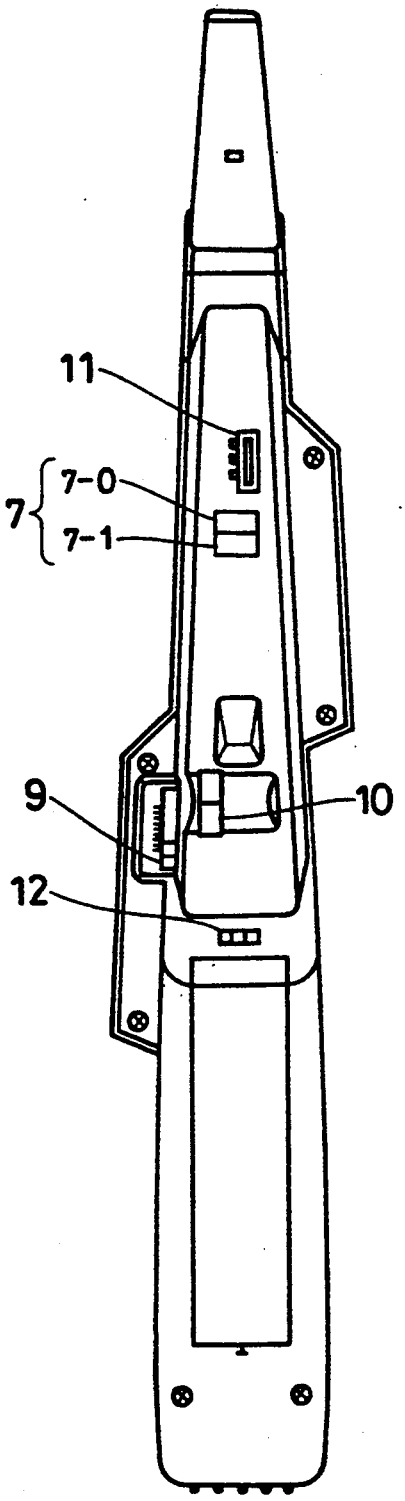
Figure 1C:
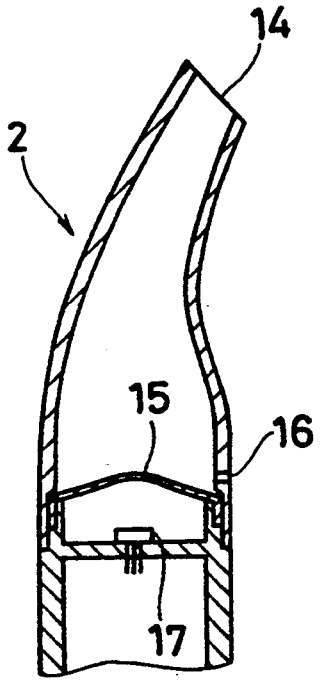

FIG. 1 (A) and FIG. 1 (B) show an appearance of an electronic wind instrument which is an example of embodiment of this invention. FIG. 1 (C) shows a cross section of a mouthpiece of the instrument. This electronic wind instrument can generate max. 5 tones simultaneously. This instrument has a form similar to that of woodwind instrument, and it is provided with a mouthpiece 2 at its front end. The player attaches the mouthpiece 2 to his lip and blows in breath to control the tone generation level. Inside the mouthpiece 2, a breath sensor 21 consisting of a photosensor 17 and an elastic diaphragm 15 (see FIG. 1 (C)) is provided. The breath intensity is detected, and the data is sent to a CPU. At the external side of the instrument, an indicator 3, a chord mode selection switch 4, a rhythm setting switch 5, and playing keys 7 are provided. The indicator 3 is a 2-digit 7-segment indicator which indicates a selected rhythm and tempo. The chord mode selection switch 4 is effective when a mode change switch 11 stated later is set to the chord mode. This switch enables selection of AUTO CHORD (AC) mode (4*a*), CHORD SEQUENCE RECORD (CSR) mode (4*b*), CHORD SEQUENCE PLAY (CSP) mode (4*c*) and AUTO HARMONY (AH) mode (4*d*). The rhythm setting switch 5 consists of rhythm selection switches 5*a* and 5*b*, tempo up/down switches 5*c* and 5*d*, and a start/stop switch 5*e*. Keys 6 is a group of the tone color selection switches. Playing keys 7 (7–0 to 7–14) are provided at the front side of the instruments and at the center of its rear side. The keys 7–0 to 7–7 are controlled by the left-hand fingers, whereas the keys 7–8 to 7–14 are controlled by the right-hand fingers. A specific pattern can be obtained by combining ON/OFF of these keys, thereby determining a sound pitch. The keys 7–2 to 7–14 are used mainly to determine the scale, and the keys 7–0 and 7–1 are used mainly to determine the octave. A mode change switch 11 is provided at the rear side of the instrument. This mode change switch 11 is a 3-step slide switch. A slider is moved to set the single tone mode, the ensemble mode, or the chord mode. A speaker 8 is provided in the lower part of the instrument and outputs playing tones. A knob 9 provided at the rear side is a main volume knob which is moved up and down to regulate the sound volume of instrument. (The sound volume can be also controlled by a breath sensor 21.) 10 is a pitch bend wheel which is turned up and down to shift the musical tone pitch (frequency) up and down.

12 is a power switch. As will be stated later, when the power switch 12 is turned on, the breath intensity is set. Namely, when the player turns on the power switch 12, blowing a breath with a proper intensity into the mouthpiece 2, a sensor voltage BV (sensor detection value) caused by blowing is set as a value corresponding to the reference breath intensity data BDO. Generally, the breath intensity data for mezzo forte is stored as the reference breath intensity data BDO, therefore, the player turns on the power switch 12, blowing into the mouthpiece with a proper breath intensity which he regards to be mezzo forte.

As shown in FIG. 1 (C), the mouthpiece 12 has a slit 14 at its front end, from which breath is blown in. In the mouthpiece, an elastic diaphragm 15 which accepts the breath blown from the slit 14 is provided. A discharge port 16 to discharge the blown breath is provided at a side of tube. Inside the elastic diaphragm 15 (opposite to slit 14) a photosensor 17 is provided. This photosensor 17 has a light emitting part and a light receiving part. The light receiving part detects the amount of reflected light. If the elastic diaphragm 15 moves up or down, the detected value of the light receiving part changes. When the player blows breath into the slit 14, the elastic diaphragm 15 is depressed by the breath pressure. The photosensor 17 detects the depression, converts the depression force into voltage and outputs it. Thus, the breath intensity is detected. The breath sensor 21 consists of elastic diaphragm 15 and photosensor 17.

Figure 2:
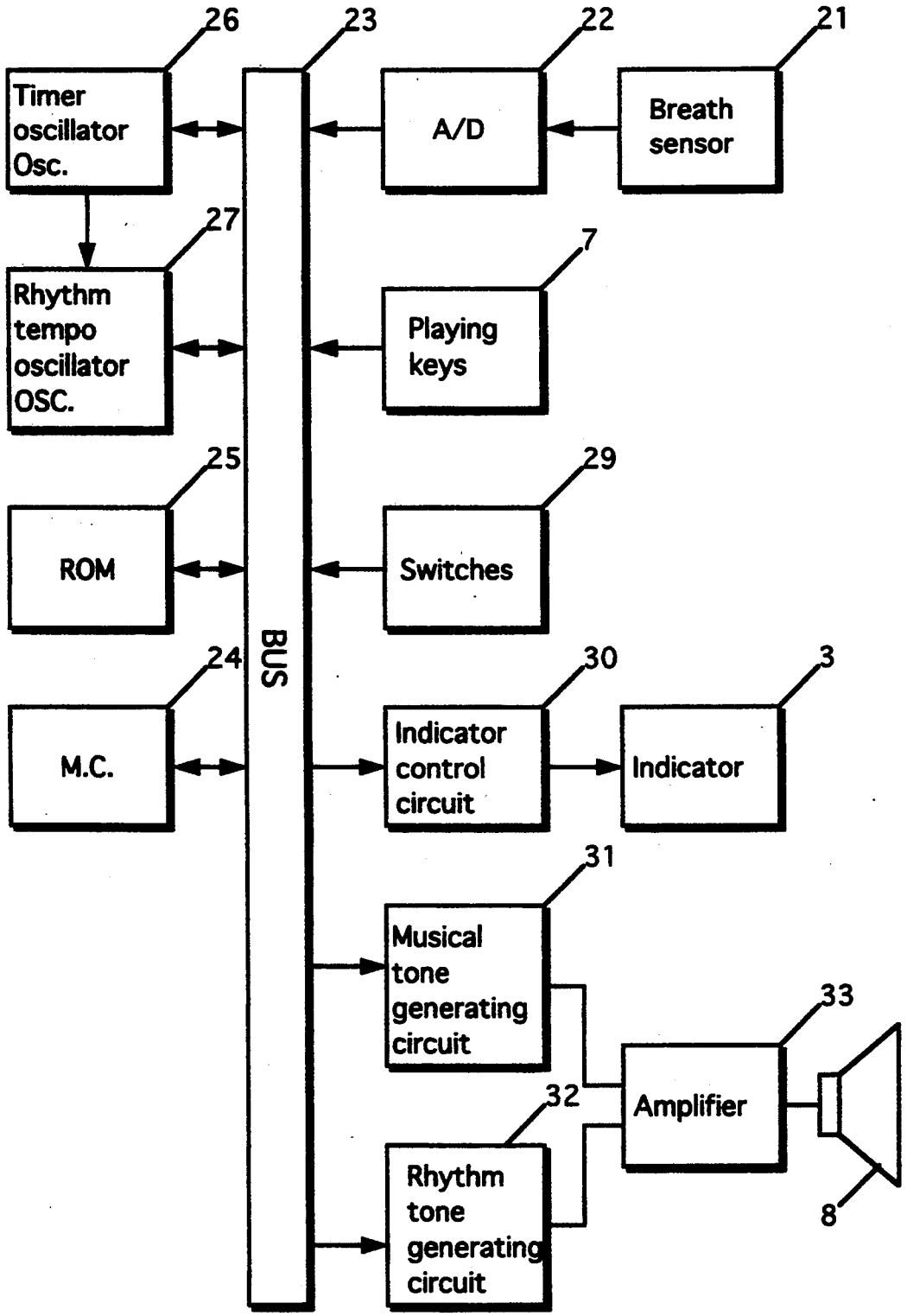
FIG. 2 is a block diagram of a control section of the electronic wind instrument.

FIG. 2 is a block diagram of the electronic wind instrument stated above. A microcomputer 24, an I/O device, and an operation section are connected through a bus 23. The above-mentioned breath sensor 21 is connected to the bus 23 through an A/D converter 22. The breath intensity detected by the breath sensor 21 is converted into the digital data by the A/D converter 22 and sent to the microcomputer 24 through the bus 23. A ROM 25 storing the fingering data and tone color data, a timer oscillator 26, a rhythm/tempo oscillator 27, playing keys 7, function switches 29 (including the chord mode selection switches 4, rhythm setting switches 5, tone color selection switches 6 and mode change switch 11), an indication control circuit 30, a musical tone generation circuit (sound source) 31 and a rhythm tone generation circuit (rhythm source) 32 are connected to the bus 23. The microcomputer 24 periodically scans the playing keys 7 and function switches 29 to detect ON/OFF event. The timer oscillator 26 always generates the clock signals of specified period. The rhythm tempo oscillator 27 generates the clock signal of 96 counts/2 measures with a set tempo. The musical tone generation circuit 31 is a circuit to generate musical tone based on the tone color data and level data inputted by the microcomputer 24. The rhythm tone generation circuit 32 is a circuit to generate the rhythm tone (tone color of rhythm instrument). An amplifier 33 is connected to the musical tone generation circuit 31 and the rhythm tone generation circuit 32. It amplifies the generated musical tone and outputs from a speaker 8.

(Explanation of playing mode)

1) Single tone mode
The sound pitch is determined by the key pattern of the playing keys 7. The tone generation level is controlled based on the breath intensity (initial intensity (peak value of initial breath intensity)(the same is valid to the following)). The number of generated tones is always 1.

2) Ensemble mode
The max. number of generated tones is 5. As with single tone mode, the sound pitch is determined by the pattern of the playing keys. Sound pitches are assigned to all the sound sources (channels). However, a pitch deviation of several cents is set for each channel to get chorus effects. Not only the tone generation level, but also the number of generated tones, is controlled by the breath intensity. Namely, the number of generated tones is changed within the range of 5–1, as the breath intensity is changed.

3) AC (AUTO CHORD) mode
The root is determined by the key pattern of the playing keys 7–2 to 7–14, and the type is determined by the key pattern of the keys 7–0 and 7–1. The chord composing tones are assigned to channels 1 to 5.

4) CSR (CHORD SEQUENCE RECORD) mode
The same tone as in the AC mode is generated by the same operation as with the AC mode, and the played chord and its length (number of beats) are memorized successively.

5) CSP (CHORD SEQUENCE PLAY) mode
In this mode the chords stored in the CSR mode are reproduced successively. During reproduction, key pattern input and breath input are not accepted.

6) AH (AUTO HARMONY) mode

This mode enables single tone playing during successively reproducing the chords stored in the CSR mode. The chord sequence is reproduced. If the player plays the instrument by the same operation as in the single tone mode, the played tone is generated from the 1 channel, and the additive tone chord is generated from the 2 to 5 channels. The additive tone is determined by taking into consideration the chord to be reproduced and the playing sound pitch. The number of generated tones (number of parts) is controlled by the breath intensity.

Configuration of Memory

Figures 3A, 3B:
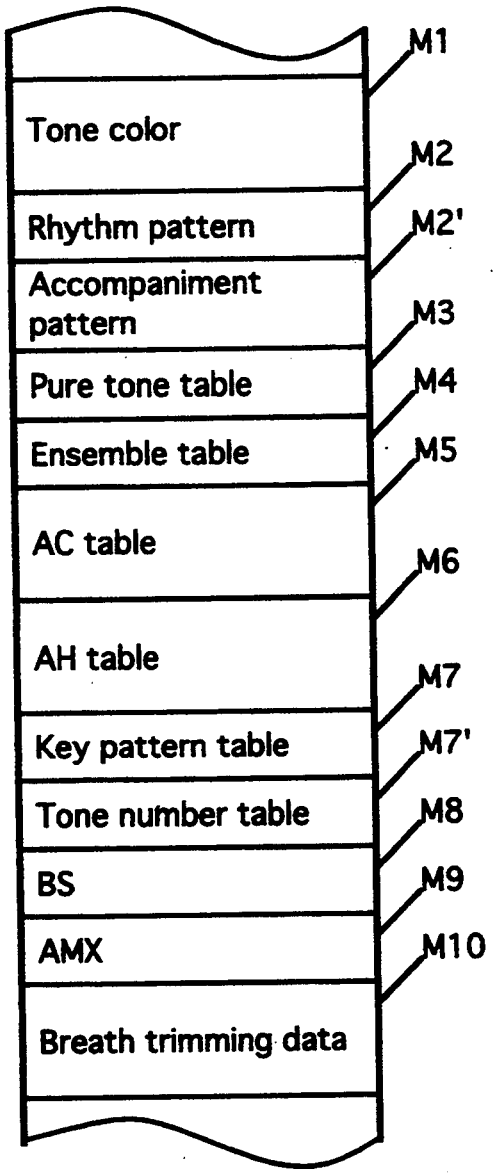
FIGS. 3 (A) to (E) show configuration of ROM of control section.
Figure 3E:
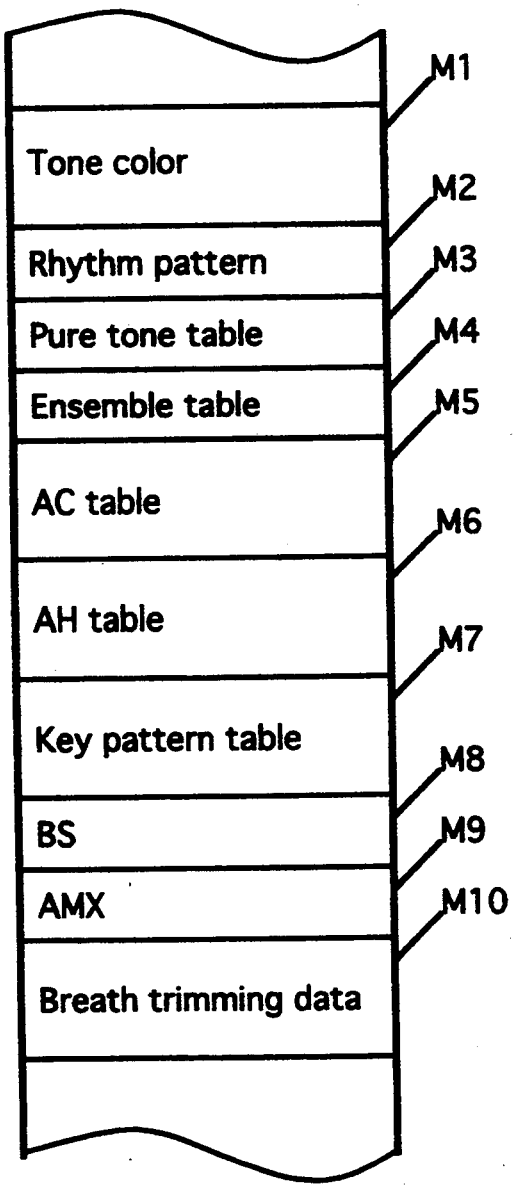
Figure 5A:
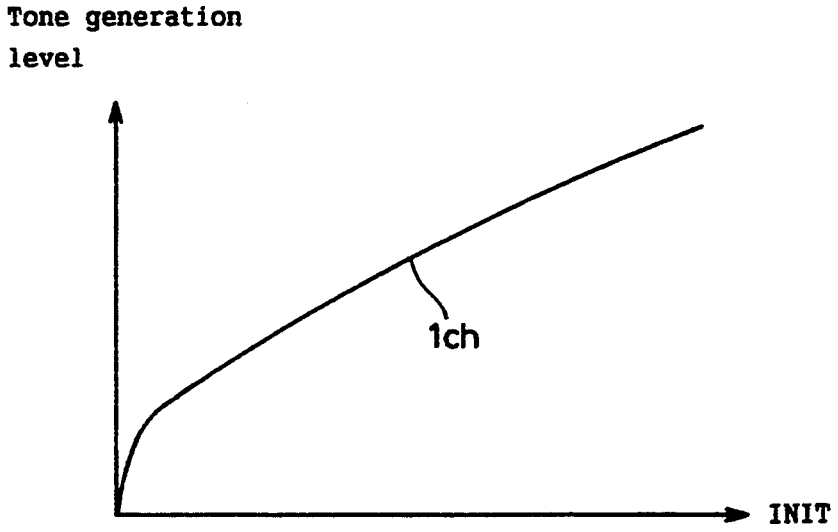
FIG. 5 (A) and FIG. 5 (B) show a single tone table and ensemble table set in a ROM.
Figure 5B:
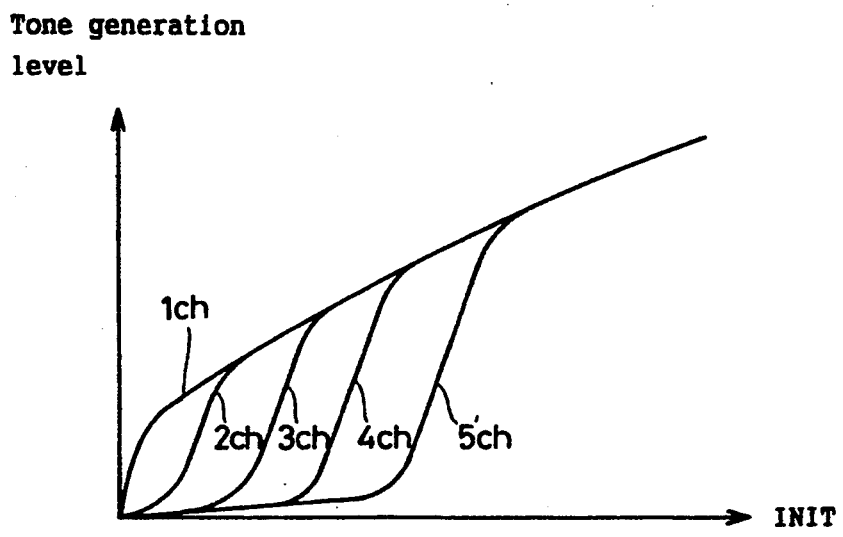

FIG. 3 shows the content of the memory of the above mentioned ROM 25. FIG. 3 (A) shows a configuration of the ROM 25. Besides a program for controlling the instrument operation, the ROM stores tone color data (M1), rhythm pattern data (M2), accompaniment pattern data (M2'), single tone table (M3), ensemble table (M4), AC table (MS), AH table (M6), key pattern table (M7), tone number table (M7'), BS (breath threshold: M8), and AMX (M9), breath trimming data (M10), as shown in the figure. AMS indicates the maximum value of the sequence pointer as stated later In the tone color data memory area M1 the waveform data and envelope data of each tone color selected by the tone color selection switch 6 are stored. The rhythm pattern data memory area M2 stores the data for the rhythm instrument, such as tone generation timing, beat and number of clocks of one beat, for each rhythm pattern. The accompaniment pattern memory area M2' stores the accompaniment (broken chord) pattern for each rhythm pattern. In the single tone table M3 a tone generation level of one channel which corresponds to pertinent breath intensity (INIT) is stored in the form of the table. FIG. 5 (A) indicates a correlation between the breath intensity and tone generation level stored in this table.

Figure 9A:
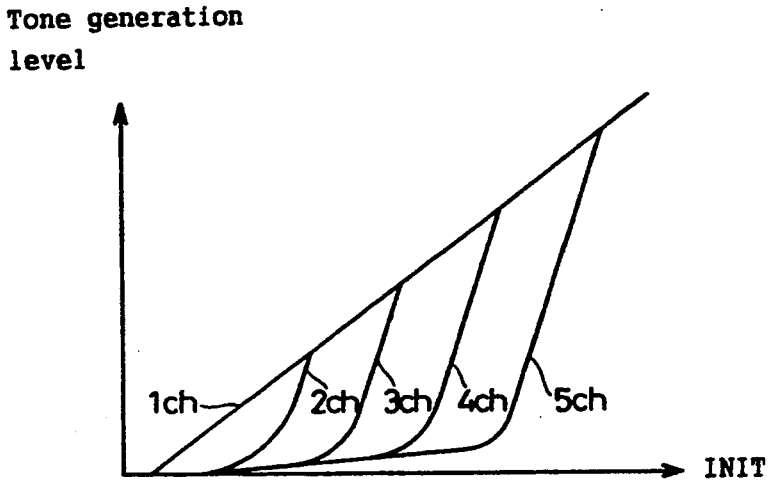
FIG. 9 (A) and FIG. 9 (B) show other examples of application of ensemble table.
Figure 9B:
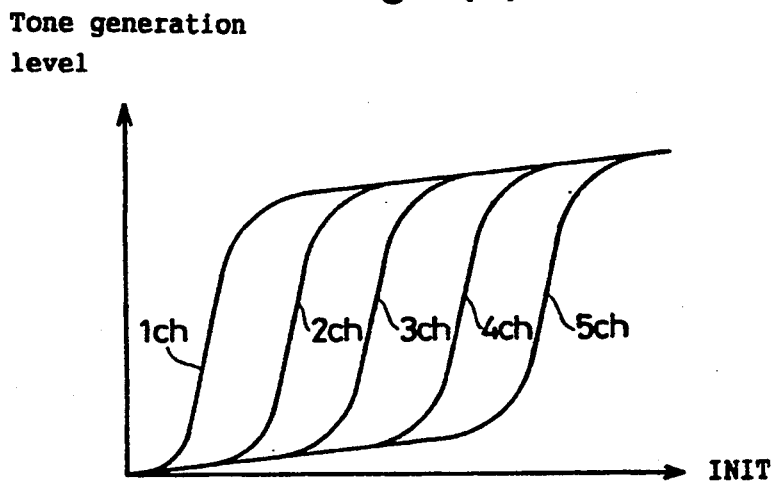

The ensemble table M4 stores the tone generation level of channels 1 to 5 which corresponds to pertinent breath intensity in the form of table. FIG. 5 (B) shows a correlation between the breath intensity and tone generation level of each channel which are stored in this table. As shown in this figure, in some modes such as ensemble, the level rise differs depending on channel, therefore the number of generated tones (number of parts) can be increased or decreased by changing the breath intensity. The ensemble table M4 is used in the ensemble mode and AH mode to control the number of generated tones and number of parts. Besides the correlation type shown in FIG. 5 (B), this ensemble table can be arranged as correlation type as shown in FIGS. 9 (A) and (B). In the case of correlation type shown in FIG. 9 (A) the tone generation level correlates completely with the breath intensity, and the number of generated tones is increased or decreased according to this correlation. On the other hand in FIG. 9 (B), when the breath intensity exceeds a specific level, the tone generation level becomes almost constant; and the whole tone generation level is increased or decreased by changing the number of generated tones. The ensemble table shown in FIG. 5 (B) has an intermediate correlation between correlations shown in FIG. 9 (A) and (B).

The AC table M5 has a configuration as shown in FIG. 3 (B). The numbers of tones to be generated at the channels 1 to 5 for each chord type are stored as number of semitones from the root of a chord (number of semitones which represent a distance between two specific tones on the assumption that a semitone is counted as unit). For example, when a dominant seventh chord (a chord of TYP 7 in the figure) whose root is G (so) is generated, the root "G", "B:si" (higher than "G" by 4 semitones) (maj or third), "D: re" (higher than "G" by 7 semitones) (perfect fifth), "F: fa" (higher than "G" by 10 semitones) (minor seventh), "G" (lower than "G" by two octaves) are assigned to the channel 1, channel 2, channel 3, channel 4, and channel 5, respectively. Here, the symbol indicates a lower tone, i.e. "-24" means a tone 2 octave below. This tone is used as a base tone in the AC mode.

FIG. 3 (C) shows a partial configuration of the AH table M6. This table stores the type (M60) of chords stored in the chord sequence memory (CSM, stated later). This table stores also the tone pitches assigned to the channels 2 to 5 each number of semitones which represents the difference between the chord root and the pitches determined by depressing key pattern (M61). The above tone pitches are stored as a number of semitones from the root. The underlined number indicates a tone one octave below (the number of semitones is —12). For example, underlined number "4" represents -8(-12 +4: minor sixth below). The tones of the channels 2 to 5 are lowered by one octave in order to emphasize the melody to be generated by channel 1.

In the key pattern table M7 the key pattern to specify each pitch is specified. The key pattern is specified, resembling the fingering of natural instruments. Available systems are recorder system and saxophone system.

BS (M8) is breath threshold data. When the breath intensity data (BS: stated later) exceeds the BS, it is judged that the instrument is played. AMX is max. value of the index A of chord sequence memory (CSM (A)) and indicates the max. number of steps of chord sequence which can be stored in memory.

FIG. 3 (D) shows the breath trimming data.

FIG. 4 shows a key pattern table (M7) and a tone number table (M7'). FIG. 4 (A) and FIG. 4 (B) show key patterns in the recorder mode. These key patterns are arranged so that a specific pitch can be specified when the playing keys 7 are operated by the fingering similar to that of a recorder. If the key pattern of the playing keys 7 corresponds to any of them, the pertinent pitch is sent to the musical tone generation circuit 31. FIG. 4 (D) is a tone number table which stores the pitches corresponding to the above-mentioned key patterns. First, the pertinent key pattern(playing key pattern) is retrieved in the key pattern table,resulting in outputting a pointer data indicating the pertinent key pattern, next the tone number table is retrieved with value of the pointer "i". Therefore a corresponding pitch can be found. This pitch is expressed as a number of semitones from C3.

FIG. 4 (C) shows a key pattern table of the saxophone mode, and FIG. 4 (E) shows a tone number table of the saxophone mode. Using these tables, it is possible to specify the pitch by the fingering similar to that of saxophone. In the saxophone mode the available tone range is a little over one octave, TN=0 to 15 or TN=-2 to 13. However, practically, using the octave key, it is possible to generate tones higher by three octaves. In this table both of TN data (TN=0 to 15, TN=-2 to 13) are available for specifying the pitch.

The TN data, TN=-2 to 13 is more similar to the fingering of the saxophone.

Figure 6A:
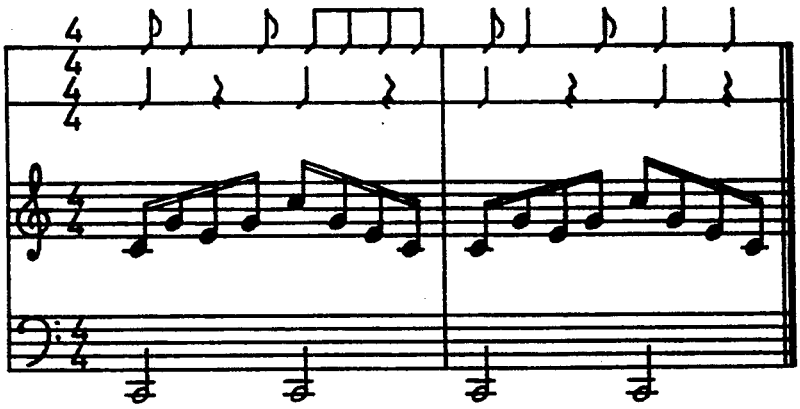
FIG. 6 (A) and FIG. 6 (B) show a rhythm pattern and an accompaniment pattern set in a ROM.
Figure 6B:
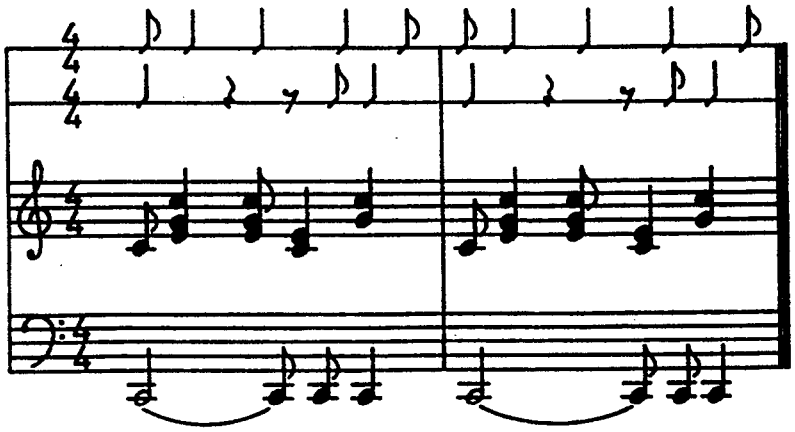

FIGS. 6 explain the storage data of the above-mentioned rhythm pattern table (M2) and accompaniment pattern table (M2'). In FIGS. 6 (A) and (B) the upper part shows the rhythm pattern. A timing to generate tone of several percussion instruments is stored as a pattern of two measures. This pattern is repeated at the 3rd measure and on. The middle and lower parts show the accompaniment patterns. The middle part indicates the broken chord, and the lower part indicates the base tone. The composing tones correspond to the channels, respectively. Namely, the four tones of a broken chord correspond to the channels 1 to 4, and the base tone corresponds to the channel 5. The timing of tone generation and clearing of rhythm and accompaniment is judged by the rhythm interruption function stated later (FIGS. 8 (M) and (N)). The tone is generated and cleared with a specified timing.

FIG. 3 (E) shows another example of the content of the ROM25 which includes a rhythm pattern table (M2) containing an accompaniment pattern table (M2') and a key pattern table (M7) containing a tone number table (M7').

FIG. 7 shows a list of register (tables, buffers) and flags which are set in the RAM of a microcomputer 24.

A—Sequence pointer: An index to indicate the sequence step No. in the CSR/CSP/AH mode B—1-beat clock register: A register to set the number of clocks (resolution) of a beat in a set rhythm pattern BD—Breath intensity data buffer BF—Breath ON flag: A flag which is set when the breath intensity exceeds the breath threshold (BS)

BEET—Beat counter: A counter register to count the number of beats in the CSR/CSP/AH mode BRTH1/2/3—Breath intensity register: A register to store the breath intensity data (BD) detected by breath interruption. One breath interruption causes one breath intensity data detection. The latest one is stored in BRTH3, the previous one is stored in BRTH2, and data detected before previous one is registered in BRTH1. When BRTH 3<BRTH2 or BRTH 3=BRTH 2=BRTH 1, the breath intensity data peak (initial intensity) is considered to have passed, and the PH (peak hold flag: stated later) is set.

BUF, BUFA, BUFB—Fingering pattern buffers: The BUFA is a buffer to take in the latest key pattern, the BUF is a buffer to store the previous key pattern. The contents of these buffers are compared, and ON/OFF event of the keys 7-0 to 7-14 is Judged. The BUFB is a buffer in which the key pattern of the keys 7-2 to 7-14 determining the scale in the AC mode is written.

CSR—Chord sequence record flag: A flag for indicating that the CSR mode is operating.

FM—Fingering mode flag: A flag for indicating the fingering mode, recorder mode (0) or saxophone mode (1).

i—Key pattern pointer: A register to store the key pattern ID No. stored in the key pattern table INIT—Initial intensity register: A register to store the initial peak of breath intensity in breath interruption as an initial intensity LTH—Chord length register: A register to store the number of beats required to generate one chord in the CSR/CSP/AH mode MODE—Mode register: A register to store the playing mode 0—Single tone mode 1—Ensemble mode 2—AC mode 3 CSR mode 4 CSP mode 5—AH mode OCT—Octave key buffer: A buffer to store the fingering of the octave keys in the saxophone mode PH Peak hold flag: A flag indicating that the initial intensity (INIT) has been detected RITH Rhythm pattern register: A register to store the rhythm pattern read from the rhythm pattern memory ROOT—Root register: A register to store the chord root RP Rhythm pattern No. register: A register to store the rhythm pattern No.

RSV—Reserve flag: A flag indicating that there is a deviation from the beat timing and there exists a chord waiting for tone generation until next beat timing RUN—RUN flag: A flag indicating that the rhythm tone generation circuit 32 or CSR/CSP/AH mode is operating T—Clock counter: A counter which is incremented whenever the rhythm interrupt occurs. Usually, 96 counts compose 2 measures. The rhythm pattern is set based on this length.

TC—Tone color No. register: A register to store the tone color No. TEMP—Tempo register: A register to store the tempo TYP Chord type register: A register to store the chord type. This register is used together with the above-mentioned ROOT to specify the chord name (C (C major chord), Am7 (A minor 7th chord), etc.)

For the RAM of microcomputer 24, the KEYBUF and CSM tables shown in FIG. 7 (B) and (C) are also provided. The KEYBUF is a table consisting of the key ON flags KON of the channels 1 to 5 and tone number register TN. When the data stored in this table is sent to the musical tone generation circuit 31 (simultaneously the tone generation level is specified), a tone is generated. It is possible to send only the KON or TN to the musical tone generation circuit 31 or only the data of a specific channel. The CSM is a table having memory areas for ROOT, TYP, and LTH for each step specified with the sequence pointer A (0<=A<=AMX). In the CSR mode, the data are stored successively, starting from A=0, and in the CSP/AN mode the data are read and reproduced successively, starting from A =0.

Explanation of Operations

Figure 8:
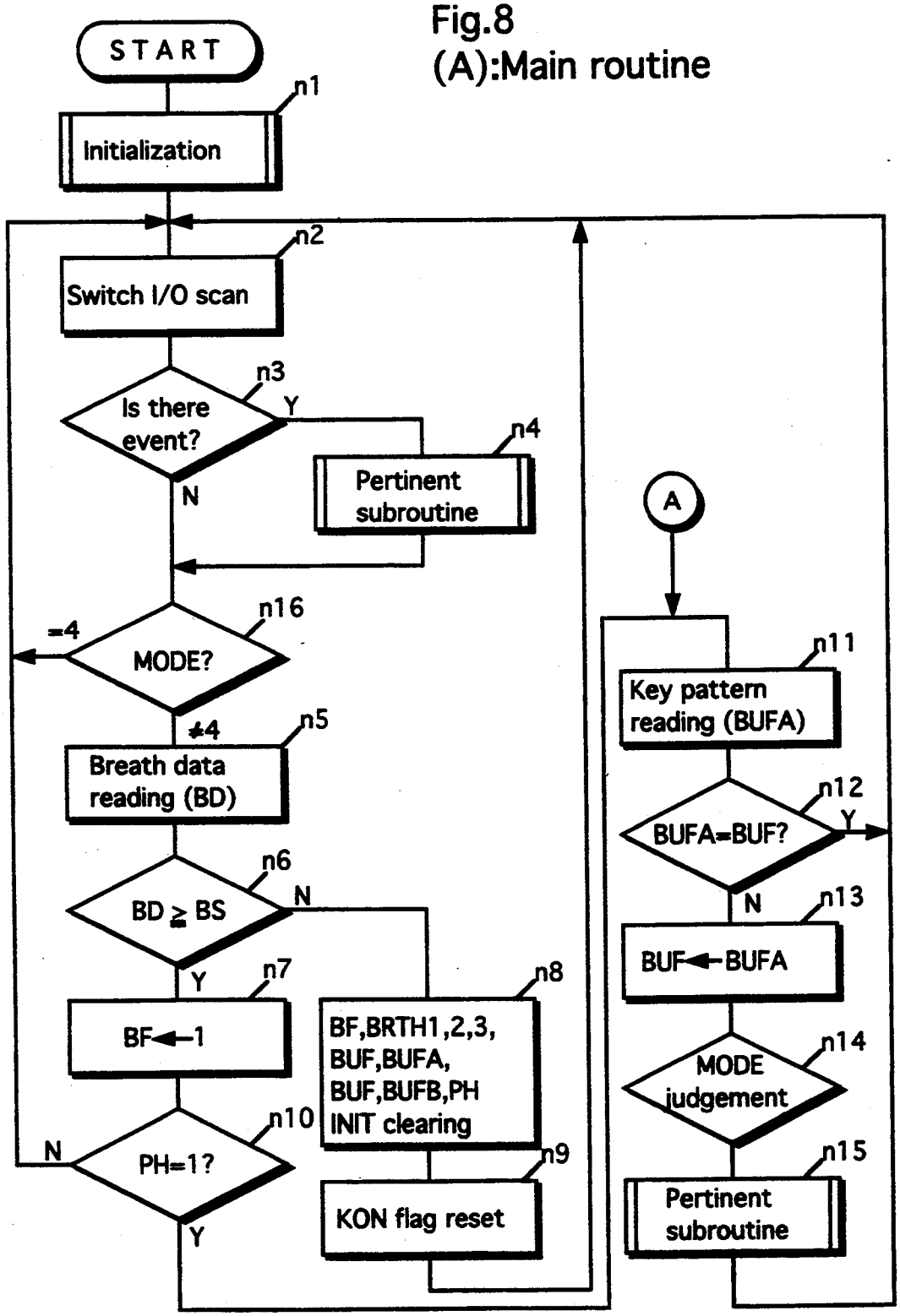
FIGS. 8 (A) to (Q) are flow charts showing the operations of the control section.

FIGS. 8 are flowcharts showing the operations of the control section.

FIG. 8 (A) shows a main routine. FIGS. 8 (B) to (H) show subroutines which are branched at the step n4 of main routine, corresponding to the switch ON event. FIGS. 8 (I) to (N) show subroutines branched at the step n15 of main routine, corresponding to the playing mode. FIG. 8 (O) and FIG. 8 (P) show rhythm interruption. FIG. 8 (Q) shows breath interruption.

In FIG. 8 (A), after the power switch 12 is turned on, at first initialization is executed (n1). In this operation, the specific tone color and rhythm pattern are preset. After completion of initialization the switch I/O is scanned at the step n2. If ON/OFF event of any function switch occurs (n3), a pertinent subroutine (FIGS. 8 (B) to (E)) is executed (n4). Next, the mode register MODE is judged (n16). If MODE=4, the process proceeds to the step n5 and on, namely the breath intensity and key pattern detections are performed. If MODE=4 (CSP mode), the process returns to the step n2. This is due to that control by the breath intensity and key pattern is not accepted in the CSP mode. At the step n5 the breath intensity data is read into the breath intensity data buffer BD, and the BD is compared with the BS (breath threshold) (n6). If BD<BS, this means that the instrument is not being played. Therefore, a breath flag (BF), a peak hold flag (PH), an initial intensity register (INIT), a breath intensity register (BRTH1/2/3), and key pattern buffers (BUF, BUFA, BUFB) are reset and cleared (nS), and at the same time the key ON flag (KON) (the top bit of the key buffer table KEYBUF) is reset (n9), and then the process returns to the step n2. If BD>=BS, the BF is set (n7), and then a judgment as to whether or not the PH has been set is performed (n10). The PH is a flag which is set when the initial intensity (INIT) is detected in the breath interruption stated later (FIG. 8 (Q)). When the initial intensity is detected, tone generation becomes possible. Therefore, if the PH has been set, this means that the INIT has been given. In this case the process proceeds to the step n11 and on (key pattern detection) to determine the pitch. If the PH has been reset, tone generation is impossible. Therefore the process returns to the step n2. At the step n11 the key pattern is read into BUFA, and it is compared with the BUF (n12). If they coincide with each other, this means that the key pattern is not changed, and the pitch of the tone to be generated is not changed. Therefore the process returns to the step n2. If BUFA does not coincide with BUF, this means that the pitch is changed. Therefore, in this case the data of BUFA is set in BUF (n13), and then an operation in the specified playing mode is executed according to MODE (n14, n15). In the case when the operations of step n11 and on are executed first, BUF =0. Therefore, the process proceeds from the step n12 to the n13 by ordinary key operation.

FIG. 8 (B) shows a breath intensity setting operation. When a power switch 12 is turned on,this operation is executed. When the power switch 12 is turned on, a current breath sensor voltage BV is taken in (n161) and a judgment as to whether or not BVmin>BV>BVmax is valid(n162). If BV is within the above-mentioned range, a coefficient R is obtained by using the reference breath intensity data BDO/BV(n163). If BV is not within the above-mentioned range, a preset coefficient RO is set in R (n 164), and the process returns. Accordingly, in the case when a player turned on only the power switch 12 without blowing in breath into a mouthpiece 2, this RO is set.

Figure 8C:
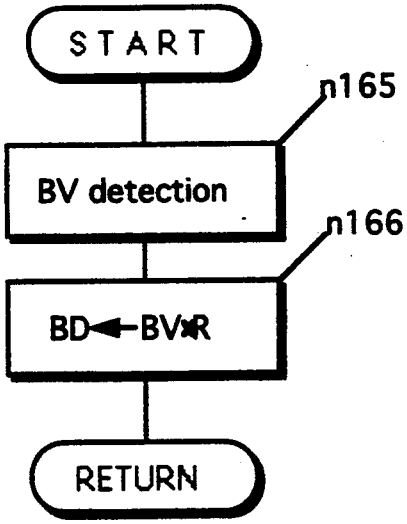

FIG. 8(C) shows a breath intensity detection operation. This operation is executed at the step n5 of above-mentioned main routine. The sensor voltage BV is read in (n165). BD is determined by multiplying BV by the coefficient R (n166). Thus obtained value is stored in a breath intensity register BD.

FIG. 8 (D) shows a tone-color selection subroutine which is executed when the tone color selection switch 6 is pressed. When any one of the tone selection switches is pressed, a tone color No. corresponding to this switch is set in the tone color No. register TC (n20), and the tone color data specified by this No. is read from the tone color data memory area M1 (n21). After this tone color data is sent to the musical tone generation circuit 31 and set there (n22), the process returns.

FIG. 8 (E) shows a playing mode setting subroutine. This subroutine is started when the mode selection switch 11 and chord mode selection switch 4 are operated. The operation is judged at the step n23, and a value corresponding to the operation is set as MODE (n24). This value indicates the mode as stated above; 0—single tone mode, 1—ensemble mode, 2—AC mode, 3—CSR mode, 4—CSP mode, and 5—AH mode. After this, each playing mode is initialized. In each playing mode, KEYBUF, BEET, A, ROOT, TYP, LTH clearing (n25) is commonly performed. If MODE=1 (ensemble mode), deviations of 0, 1, 1, 2, —2 cents are set previously in the five LFOs (oscillating circuits for modulation: circuits to control the reference waveform of musical tone. 5 circuits are provided for the channels 1 to 5) of the musical tone generation circuit 31 (n26 to 27). Hence, if musical tones of the same pitch are generated in the ensemble mode, fine pitch deviation occurs, so that concerted music effects can be obtained. If MODE=3 (CSR mode), the CSM is cleared to record a new chord sequence (n26 to 28).

FIG. 8 (F) shows a fingering mode switching subroutine. When the fingering mode selection switch 13 is pressed, this subroutine is started. In this operation the fingering mode flag FM is reversed (n131). If this flag has been reset, this means that the current mode is the recorder mode, and if it has been set, the current mode is the saxophone mode. In the pitch detecting subroutine (FIG. 8 (J)) and chord detecting subroutine (FIG. 8 (M)) stated later this flag is referenced to.

FIG. 8 (G) shows a rhythm setting subroutine. When the rhythm selection switch 5*a* or 5*b* or the tempo setting switch 5*c* or 5*d* is pressed, this subroutine is started. When the rhythm selection switch 5*a* or 5*b* is pressed, the process proceeds from the step n30 to the step n32, and the rhythm pattern No. register RP is incremented or decremented. Namely, if the rhythm selection switch 5 a is pressed, the RP is incremented, but when the rhythm selection switch 5*b* is pressed, the RP is decremented. After increment or decrement the rhythm pattern identified with the aid of RP is read from the rhythm pattern memory (n33), the number of clocks for one beat is set in the 1-beat clock register B (n34), and then the process returns. When the tempo setting switch 5*c* or 5*d* is pressed, the process proceeds from the step n31 to the step n35, and the tempo register TEMP is incremented or decremented. The switch 5*c* is used for increment, but the switch 5*d* is used for decrement. The incremented or decremented TEMP is sent to the rhythm tempo oscillator 27 (n36), and then the process returns.

FIG. 8 (H) shows a start/stop subroutine. When the start/stop switch 5*e* is pressed, this subroutine is executed. In this subroutine, at first, the RUN flag is reversed (n38). If the RUN=1, BEET is reset (n40), and the process returns. If RUN=0, RSV" and T are reset (n41, n42), and the process returns.

FIG. 8 (I) shows a flow chart. The operation of melody mode is explained below, referring to this flow chart. This operation is executed at the step n15 of the main routine when MODE=0 (single tone mode), 1 (ensemble mode) or 5 (AH mode). At the step n45 the specified pitch is detected based on the key pattern and the FM flag stored in the BUF. When the pitch is detected based on the key pattern, the pitch is once written in the tone number register TN for all channels of the key buffer KEYBUF (n46 to n47), and the process proceeds to the step n48. If the corresponding key pattern is not found in the key pattern table and the pitch cannot be detected, the KON flags for all channels are reset (n55), and the process proceeds to the step n56. At the step n48, MODE is judged. If MODE=0, the process proceeds to the step n49, the tone generation level of the channel 1 is found in .the single tone table M3, the KON flag for only channel 1 is set (n50), and then the process proceeds to the step n56. If MODE=1, the process proceeds to the step n51, the tone generation level of pertinent channel is found in the ensemble table M4, and the KON flags for all channels are set (n52). Then, the process proceeds to the step n56. If MODE=5, the process proceeds to the step n53, and the pitch of pertinent channel is rewritten according to the AH table M6. After the tone generation level of pertinent channel is found in the ensemble table M4 (n54), the process proceeds to the step n56. At the step n56, the KEYBUF is sent to the musical tone generation circuit (sound source) 31, and the process returns.

FIG. 8 (J) shows a pitch detecting subroutine to be executed at the above-mentioned step n45. In this subroutine, at first, the FM flag is referenced to (n132). If the FM flag has been reset, this means that the current mode is the recorder mode. Therefore the process proceeds to the step n133 and on to detect the pitch. If the FM flag has been set, this means that the current mode is the saxophone mode. The process proceeds to the step n138 and on to detect the pitch. In the operation of the recorder mode, at the step n133 and on, at first the BUF is written into the BUFB, and bits 6 to 8 of BUFB are rewritten to 0 (n133, n134). This is because the keys 7–6 to 7–8 are not used in the recorder mode. The key pattern table (FIGS. 4 (A) and (B)) is retrieved with this BUFB, and the No. of the relevant key pattern is set in the key pattern pointer "i" (n135). The tone number table (FIG. 4 (D)) is retrieved by using this "i" to find a tone number TN (n137), and the process returns. If the relevant key pattern is not found in the key pattern table, "&HFF" is stored in the TN register (n136 to n144), and the process returns. &HFF is a data which means that "there is no relevant key pattern: tone clear". In the operation of the saxophone mode, at the step 138 an on, at first, BUF is written into the BUFB, bits 0 and 1 are written into the OCT, and at the same time bits 0 and 1 of the BUFB are rewritten to 0 (n138, n139). This is because the keys 7–0 and 7–1 are used not to specify the tone name, but to specify the octave. The key pattern table (FIG. 4 (C)) is retrieved with the BUFB, and a relevant key pattern No. is set in the key pattern pointer "i" (n140). The tone number table (FIG. 4 (E)) is retrieved by using this "i" to find a tone number TN (n142), an increase of octave (OCT×12) by the octave key is added to this tone number (n143), and the process returns. Since OCT is a 2-bit data, shift of 4-octave tone range including the basic octave is possible. If the relevant key pattern is not found in the key pattern table, "&HFF" is stored in the TN register (n141 to n144), and the process returns.

FIGS. 8 (K) and (L) shows an AUTO CHORD subroutine. This subroutine is executed at the step n15 of the main routine if MODE=2 (AC mode). At first, at the step n60, the chord detecting subroutine is performed based on the BUF and FM flag to detect a root. The detected root is stored in the ROOT register (n63). If the root is not detected with the BUF key pattern, the process returns (n62). Next, the chord type is judged based on the chord type register TYP stored in the chord detecting subroutine (n64). If the TYP is "00", the chord is judged to be a major chord, and the pitch of pertinent channel is set according to the column M of the AC table M5 (n65). If the TYP is "01", the chord is judged to be a minor chord, and the pitch of pertinent channel is set according to the column m of the AC table M5 (n66). If the TYP is "10", the chord is judged to be a dominant 7th chord, and the pitch of pertinent channel is set according to the column 7 of the AC table M5. If the TYP is "11", the chord is judged to be a minor dominant 7th chord, and the pitch of pertinent channel is set according to the column m7 of the AC table M5 (n68). Then, the RUN flag is judged (n69). If it has been set, this means that the rhythm tone generation circuit 32 must have been actuated, and the arpeggio (broken chord: a playing method to separately generate tones composing a chord successively) matching with the rhythm pattern is performed in the rhythm interruption (FIGS. 8 (P) and ())) stated later. Therefore, the KON flag is reset (n70), and then delay from the beat timing is judged (n72). If a remainder (modulo) obtained by dividing the value of clock counter T by the value of one-beat clock register B, equals to 0 (T/B=0), this indicates that the beat timing is just now. If delay from the beat timing is less than 1/4 beat (1/4 B), it is not significant delay, and this indicates delay of player's specification, therefore, the chord is switched at once (n73). If the delay is more than 1/4 beat, the delay is so excessive that bad expression is given if the chord is switched immediately. And this indicates that the player's specification is made too early. Therefore the reserve flag RSV is set (n74), and chord switching is suspended until the next beat timing. When the RSV is set, the chord is generated in the rhythm interruption of the next beat timing. If the RUN flag has been reset, this means that the rhythm tone generation circuit 32 is not operating. Therefore, the KON flags for all the channels are set, and all tones are generated immediately (n71, n73). At the step n73, KEYBUF is sent to the musical tone generation circuit 31 so that the chord is switched, and the tone is generated.

FIG. 8 (M) shows a chord detecting subroutine executed at the above-mentioned step n61. In this subroutine, at first, the FM flag is referenced to (n145). If the FM flag has been reset, this means that the current mode is recorder mode, and the process proceeds to step n146 and on, chord detection. If the FM flag has been set, this means that the current mode is saxophone mode, and the process proceeds to the step n151 and on, chord detection. In the recorder mode operation of the step n146 and on, at first, BUF is written into the BUFB. Then, bits 0 and 1 are written into the BUFB, bits 0 and 1 of the BUFB are rewritten to "0, 1 ", and bits 6 to 8 are rewritten to "0" (n133, n134). In the key pattern of the recorder mode (refer to FIGS. 4 (A) and (B)), the bits of the keys 7–0 and 7–1 for the lowest octave (basic octave) are "0, 1". In the chord specifying mode (AC mode or CSR mode), the chord type specification with the keys 7–0 and 7–1 is accepted, and the root specification by fingering of the basic octave with the keys 7–1 to 7–14 is accepted. Thus, the bits 0 and 1 of the BUFB are specified to "0, 1" regardless of the actual fingering. The key pattern table (FIGS. 4 (A) and (B)) is retrieved with this BUFB, and the relevant key pattern No. is set in the key pattern pointer "i" (n148). The tone number table (FIG. 4 (D) is retrieved by using this "i" to find the root (TN) (n150), and the process returns. If a relevant key pattern is not found in the key pattern table, the process returns without any operation (n149). If chord specification is improper in the chord mode (if there is no relevant pattern), the chord specified previously is generated repeatedly, so that &HFF is not written. In the saxophone mode of the step n151 and on, at first BUF is written into the BUFB, and the bits 0 and 1 of BUF are written into the TYP, and the bits 0 and 1 of BUFB are rewritten to "0" (n151, n152). As in the recorder mode, the chord type specification by the keys 7–0 and 7–1 is accepted. The key pattern table (FIG. 4 (C) is retrieved by using the BUFB, and the relevant key pattern No. is set in the key pattern pointer "i" (n153). The tone number table (FIG. 4 (E)) is retrieved by using this "i" to find the root (TN) (n145), and the process returns. If a relevant key pattern is not found in the key pattern table, the process returns without any operation (n154).

FIG. 8 (N) shows a subroutine of the CSR mode (MODE=3). This subroutine is executed at the step n15 of the main routine. It is executed.when chord is changed. It sets the LTH of the chord which has finished by switching and TYP and ROOT of the chord which has been started by switching. When it is started, at first, a judgement as to whether or not the chord sequence record flag CSR has been set is performed (n80). This CSR flag must have been set at the first step (n51) of this subroutine. If the CSR flag has been reset, this means that this operation is first executed just after the CSR mode is started. In this case, the process proceeds from the step n80 to the step n51, the CSR flag is set, and at the same time the RUN and T are set to 1 and 0, respectively, and the above-mentioned AC subroutine (FIGS. 8 (K) and (L)) is performed (n82) . After that, the TYP and ROOT detected in the AC subroutine are set to the CSM (A) (in this case A=0) (n83), and the process returns. If the CSR flag has been set, the process proceeds from the step n80 to step n84, and the AC subroutine is executed. In this subroutine the TYP and ROOT are detected. After the AC subroutine, as at the step n72 stated above, delay from beat timing is judged (n85). If the delay is less than 1/4 beat, the tone can be generated immediately. Therefore, the number of beats of previous beat timing, BEET–1, is set to the LTH of CSM (A) (n86). If the delay is more than 1/4 beat, switching is performed with the next beat timing. Consequently, the number of beats of the next beat timing, BEET, is set to the LTH of CSM (A) (n87). Then, 1 is added tO the A (n88), and if A becomes larger than AMX (A>AMX) (AMX indicates maximum value of the sequence pointer A),this means that data for all the steps allocated in the sequence memory area have been stored, and the process proceeds to the step n92 to end operation. If A<=AMX, there are some remaining steps. in the sequence memory area Therefore, 0 is set in the beat number counter BEET (n90), the TYP and ROOT detected in the AC subroutine (n84) are set to the CSM (A) (n91), and the process returns.

FIGS. 8 (0) and (P) show the rhythm interruption operation. This operation is an interruption to be executed for each clock of the rhythm tempo oscillator 27. At first, RUN flag is judged at the step n95. If the RUN has been set, this means that the rhythm tone generation circuit 32 has been actuated. The step n96 and on are performed. If RUN=0, the rhythm tone generation circuit 32 is at rest. The process returns without any operation. At the step n96, the rhythm pattern register RITH is referenced to by using (T). If the rhythm pattern matches with the tone generation timing of any percussion instrument (n97), the tone generation signal of the pertinent percussion instrument channel is sent to the rhythm tone generation device 32 (n98). At the step n99 a judgement as to whether or not the current timing is beat timing is performed. (If there is no remainder when T is divided by B, the current timing is beat timing.) If it is beat timing, the right side decimal point of the indicator 3 lights (n103), and if the current timing is the 2-measure rhythm pattern (T=0) repeating timing, the left side decimal point lights, too (n101 to 102). After 1 is added to the BEET (n103), the MODE is referenced to (n104). If the MODE is 0 or 1, the process proceeds to the clock count-up operation (n112 to n114) since playing and rhythm operation are performed separately. If MODE =2 or 3, the operation of step n105 and on is performed. If MODE=4 or 5, the process proceeds to the step n115 and on. At the step n105, the RSV flag is referenced to. If it has been set, this means that the current timing is beat timing. Accordingly, KEYBUF is sent to the musical tone generating circuit 31 to change the chord (n106). After the RSV is reset (n107), the process proceeds to the step n108. If the RSV flag has been reset at the step n105, the process proceeds directly to the step n108. At the step n108 a judgement as to whether or not the current timing is cut OFF timing (clear timing of arpeggio pattern) is performed. If it is cut OFF timing, the KON flag of the relevant channel (pitch) is reset and sent (n109). At the step n110, a judgement as to whether or not the current timing is cut ON timing (tone generation timing of arpeggio pattern) is performed. If the current timing is cut ON timing, the KON flag of the relevant channel is set and sent (n111). At the step n112, 1 is added to the T. If as a result of this addition T becomes equal to 96, T is reset (n113 to n114), and the process returns. If T<96, the process returns without any operation. If the current timing is not the beat timing at the step n99, the process proceeds to the step n100, and the MODE is judged. If it is 0, 1, or 5, the process proceeds to the step n112. If it is 2, 3, or 4, the process proceeds to the step n108. Also, in the AH mode (MODE=5), the steps n108 to n111 are skipped because the number of generated tones is increased or decreased depending on the breath intensity and, therefore, arpeggio i s unnecessary. At the step n115 the BEET and LTH are compared. If the BEET does not match with the LTH, the MODE is judged at the step n124. If mode is 4, the process proceeds to the step n108, and if mode is 5, the process proceeds to the step n112. If the BEET matches with the LTH, this means that the chord is changed. Accordingly, CSM (A) is read (n116). If the read data is not data stored in END DATA (CSM (AMX +1)), this data is set in ROOT, TYP and LTH (n119), 1 is added to A, and is set in BEET (n120). After this, MODE is judged (n121). If mode is 4, the AC table is retrieved by using TYP and ROOT, and after the tone number is assigned to each channel (n121 to n122), the process proceeds to the step n108. If MODE is 5, the AH table is referenced to. After the tone number is assigned to each channel (n121 to n123), the process proceeds to the step n112.

FIG. 8 (Q) shows the breath interruption. This operation is an interruption to be executed approximately 20ms to detect the initial breath intensity. At first, the breath flag, BF, and peak hold flag, PH, are referenced to (n125, n125'). If the BF has been set and the PH has been reset, this means that the instrument is being played, but the initial intensity has not been detected.

Then, the operation of steps n126 and on is executed. If the BF has been reset, this means that the instrument is not being played. If the PH has been set, this means that the initial intensity has been detected already. Then the process returns without any operation. At the step n126, the content of the breath intensity register is shifted. Namely, BRTH1<=BRTH2, BRTH2<=BRTH3, BRTH3<=BD is executed. If BRTH3<BRTH2or BRTH3=BRTH1, this means that the initial breath intensity has been detected. Therefore, the peak hold flag PH is set (n127, n128 to n130), and the process jumps to the step n11 (key pattern detection). The initial intensity has been stored in the initial intensity register INIT. I BRTH3>=BRTH2 and BRTH3=/BRTH1 (naturally, BRTH3 BRTH1), the max. value of detected breath intensity, namely BRTH3, is set in INIT (n129), and the process returns. In the example mentioned above, the coefficient R is determined by arithmetic operation of BDO/BV. There is a system where the range of values of BV is divided into several parts, and a coefficient R is set for each of them (R1 to Rn).

Figure 8B:
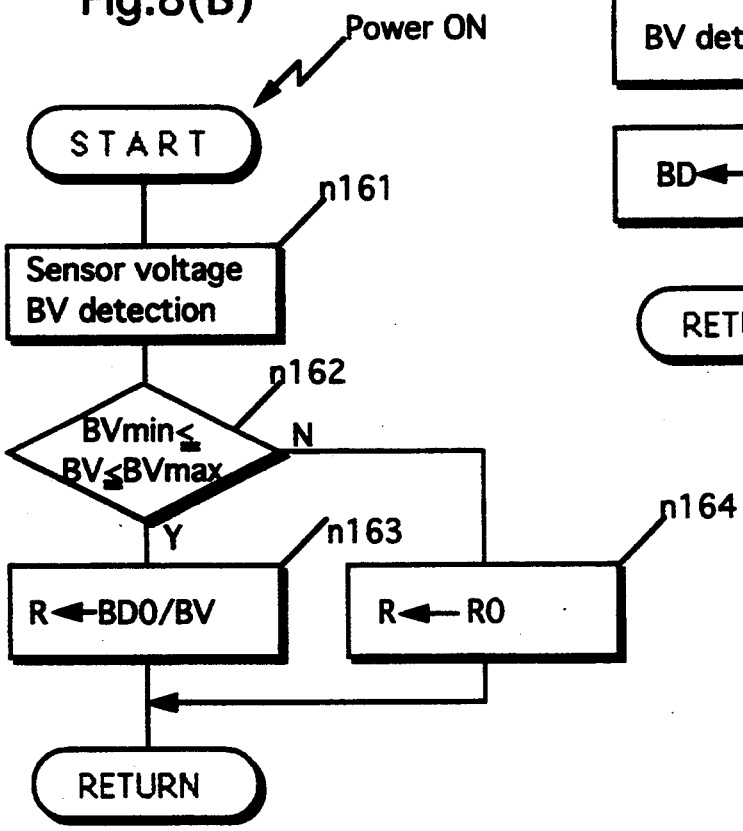
Figure 8:
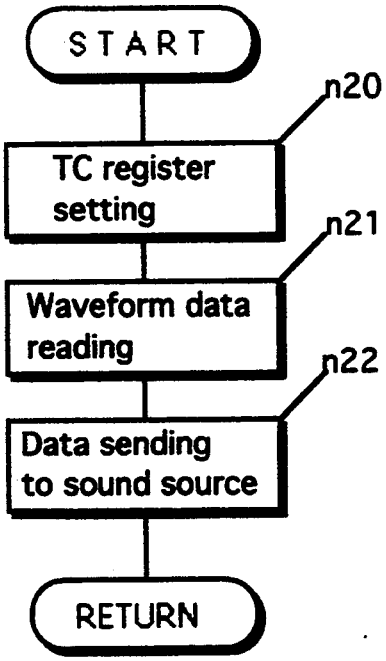
Figure 8:
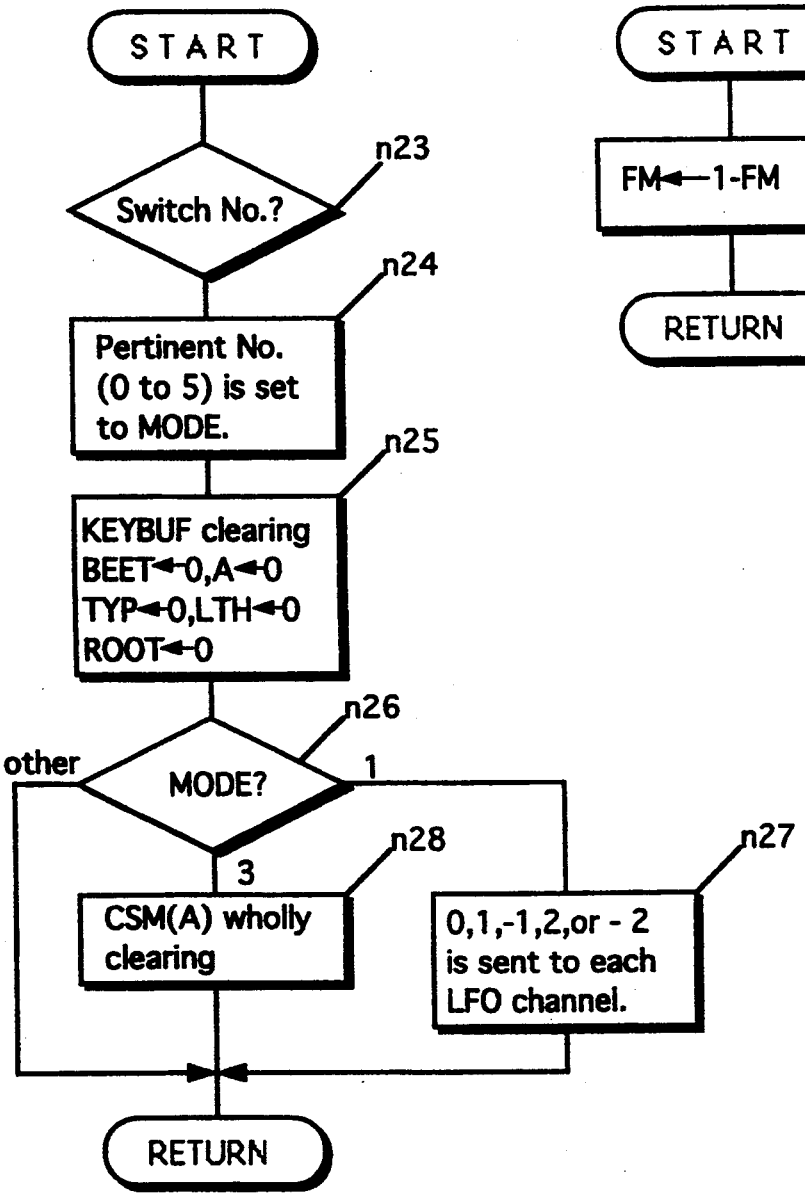
Figure 8:
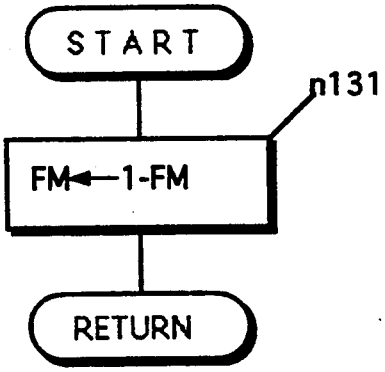
Figure 8:
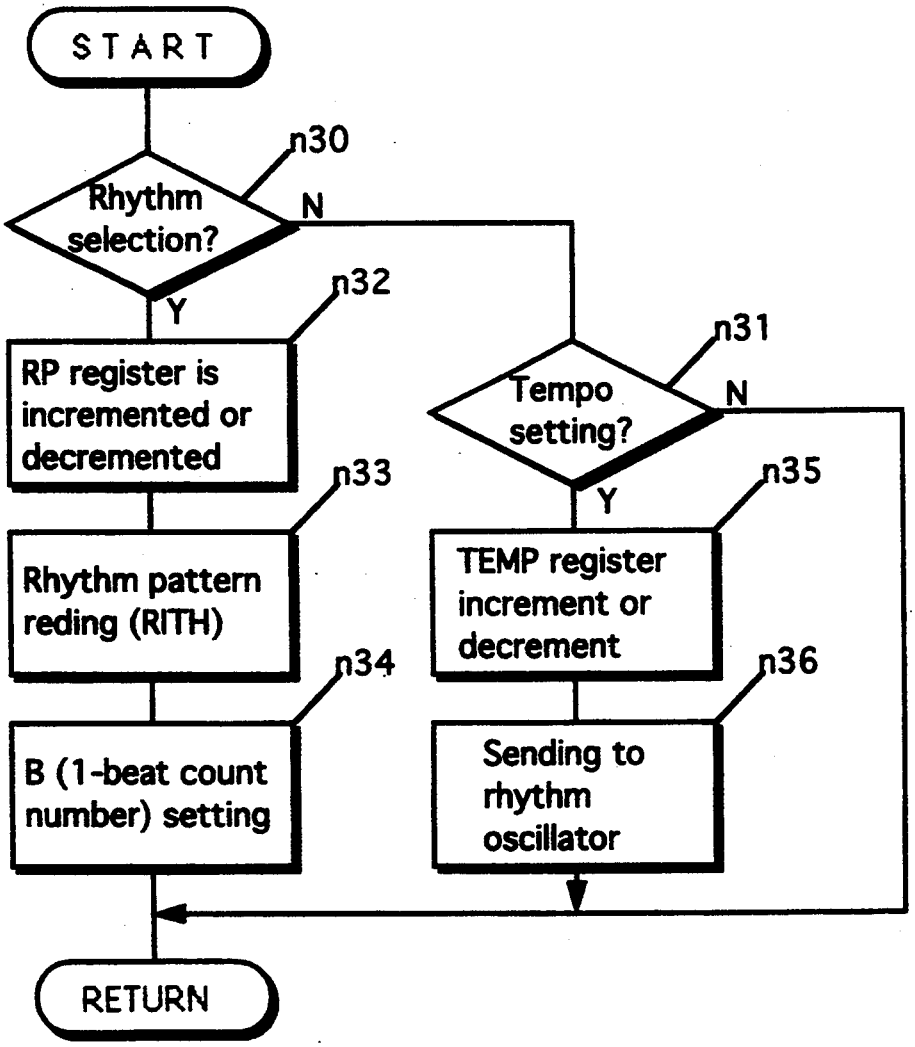
Figure 8:
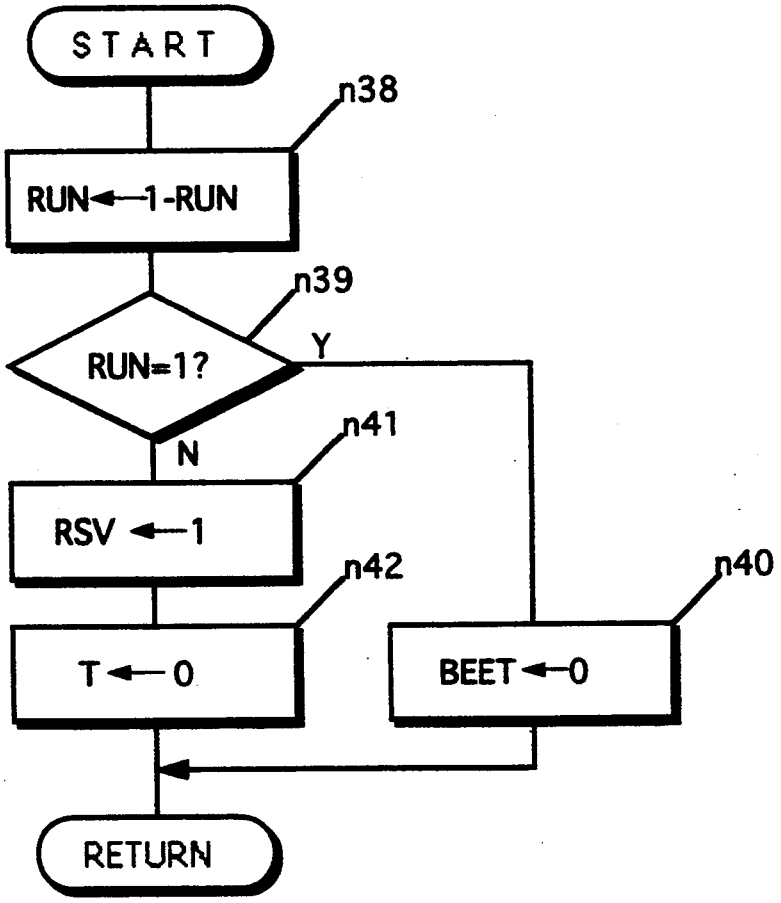
Figure 8:
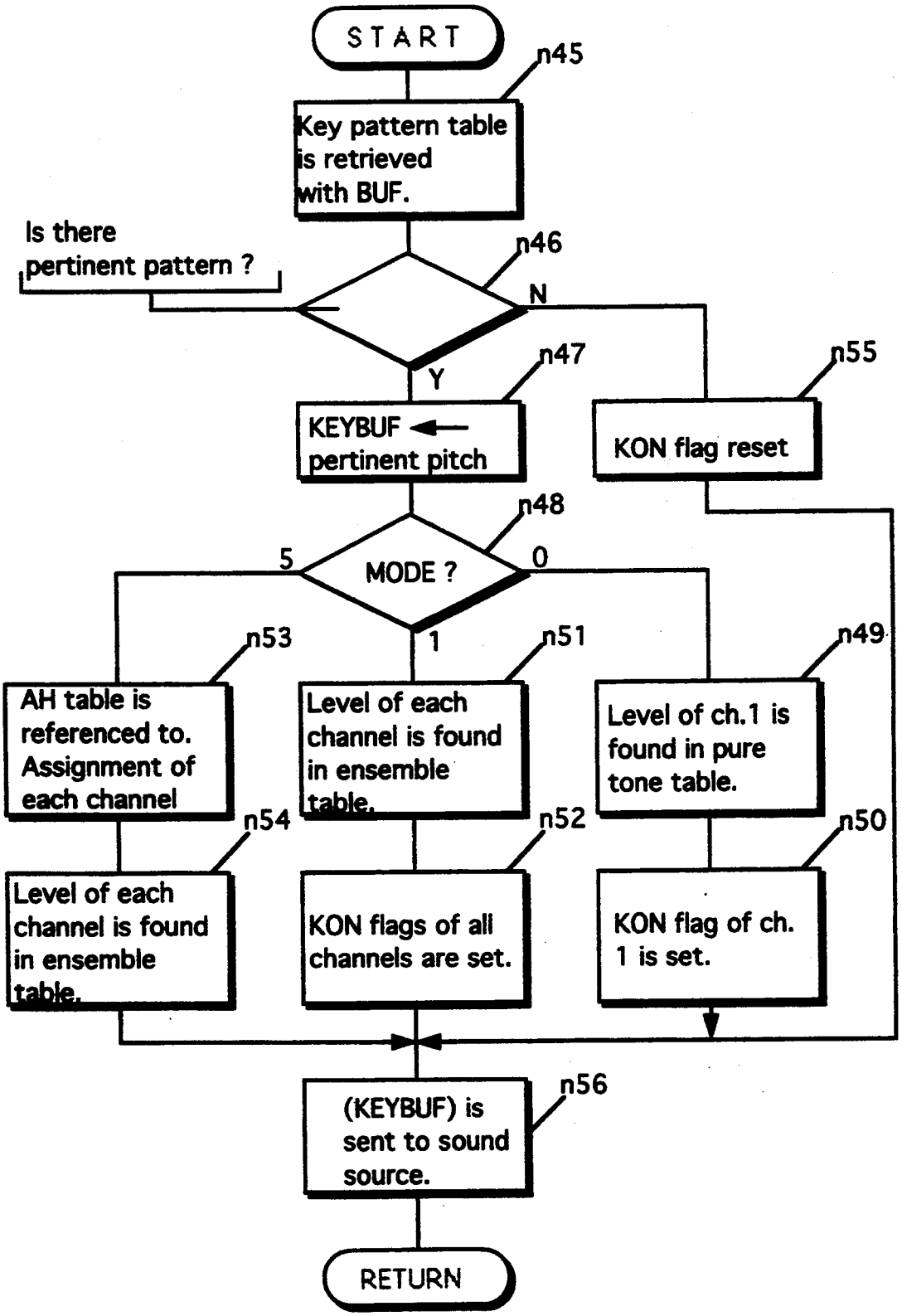
Figure 8:
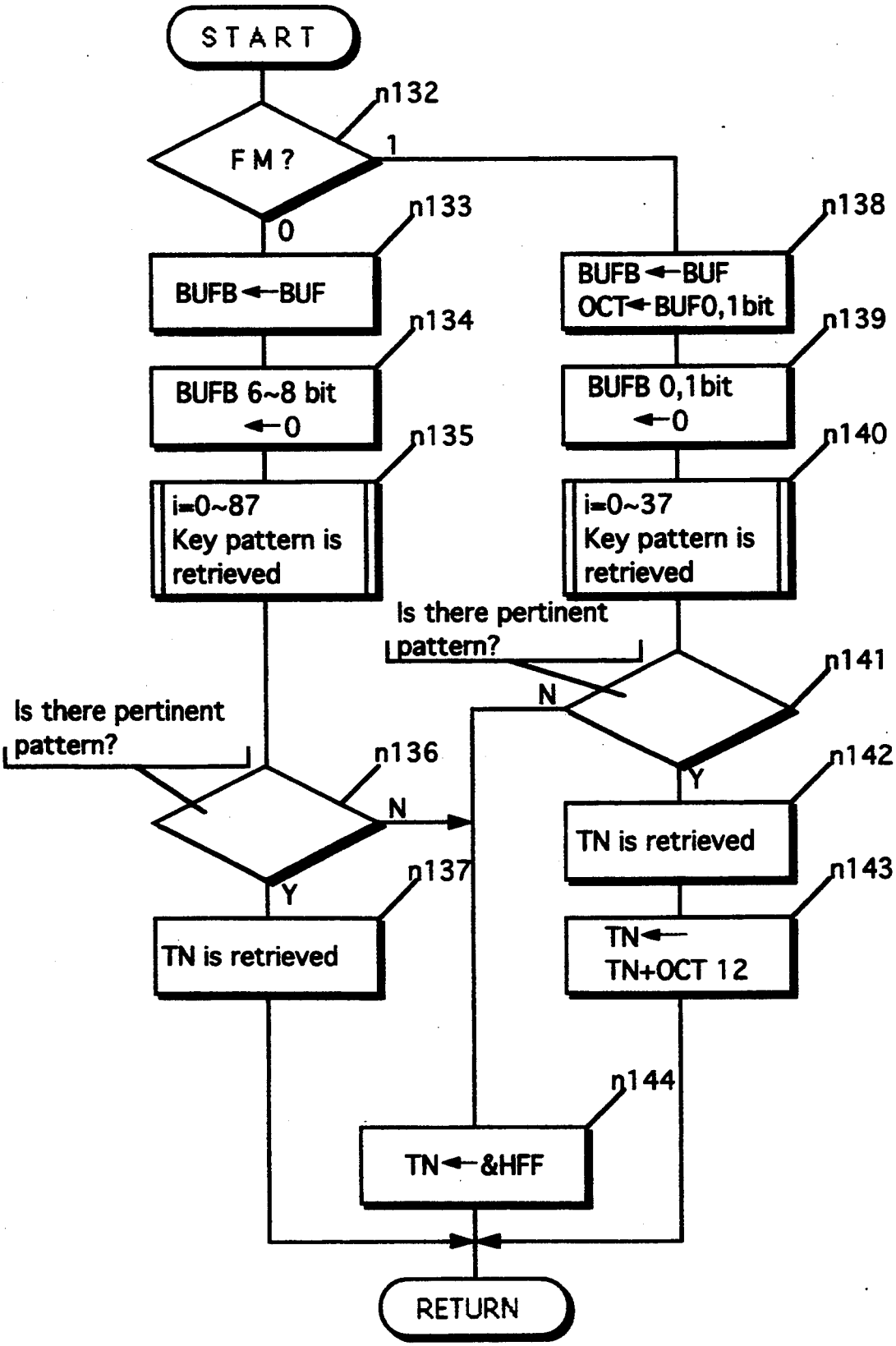
Figure 8:
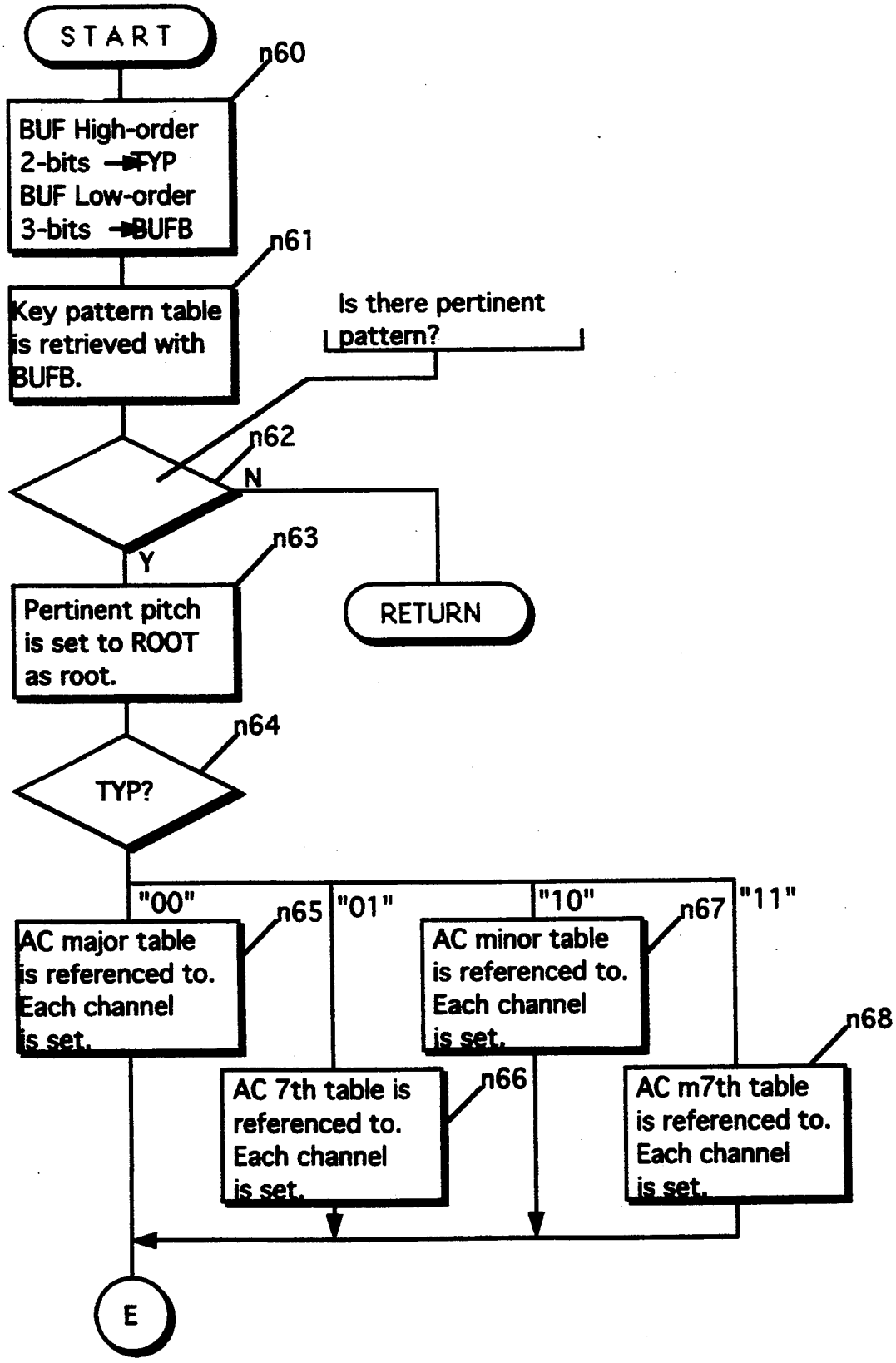
Figure 8L:
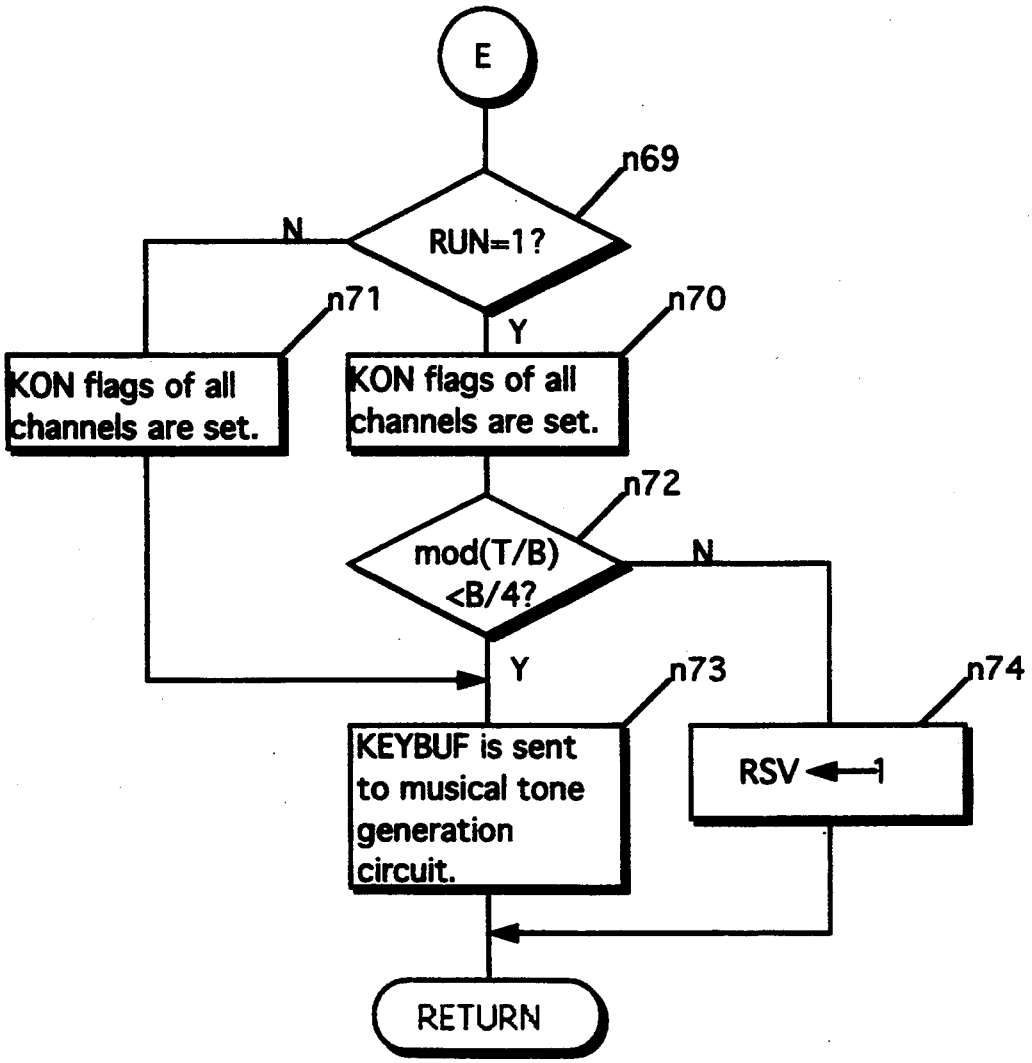
Figure 8:
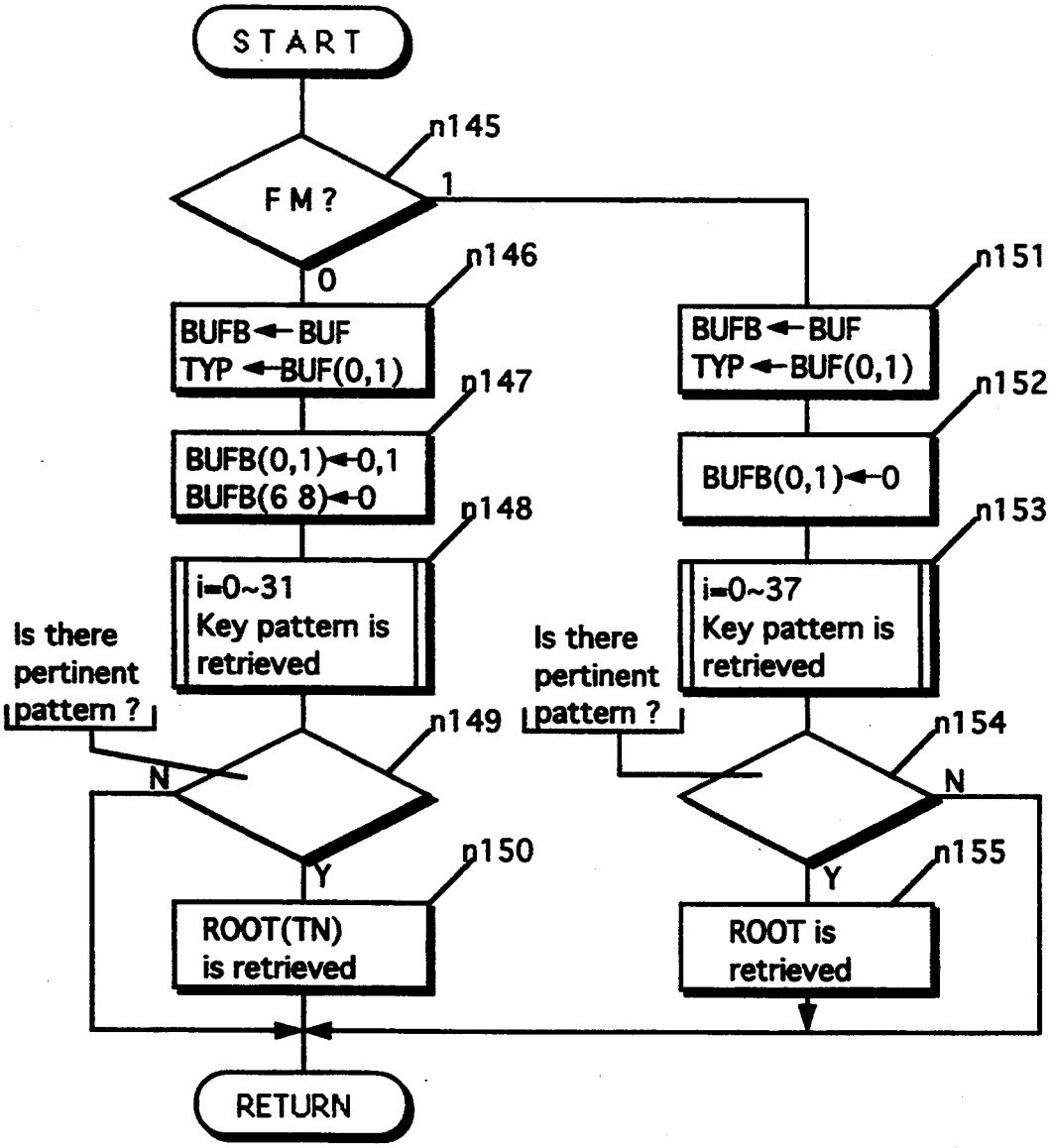
Figure 8:
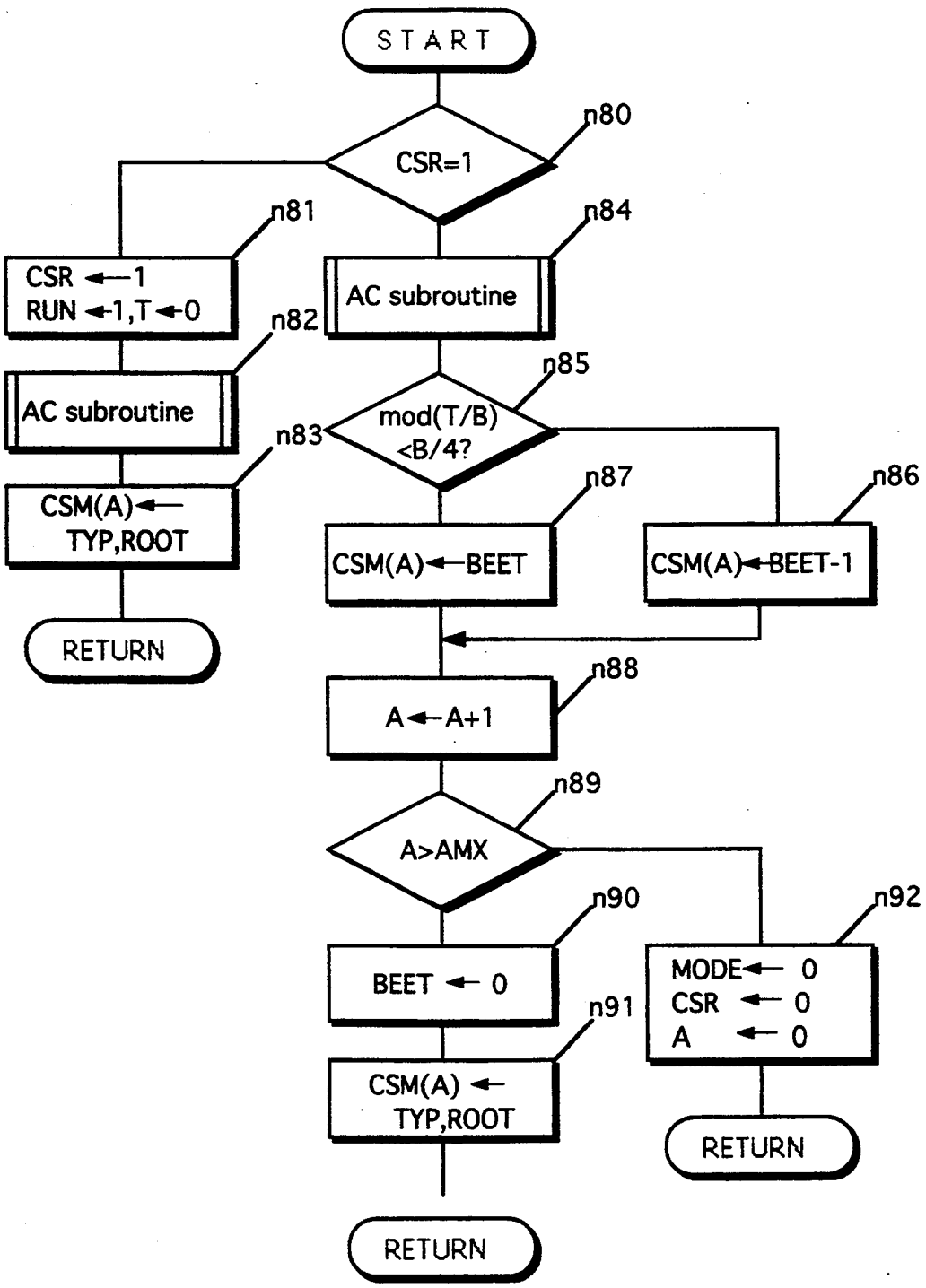
Figure 8:
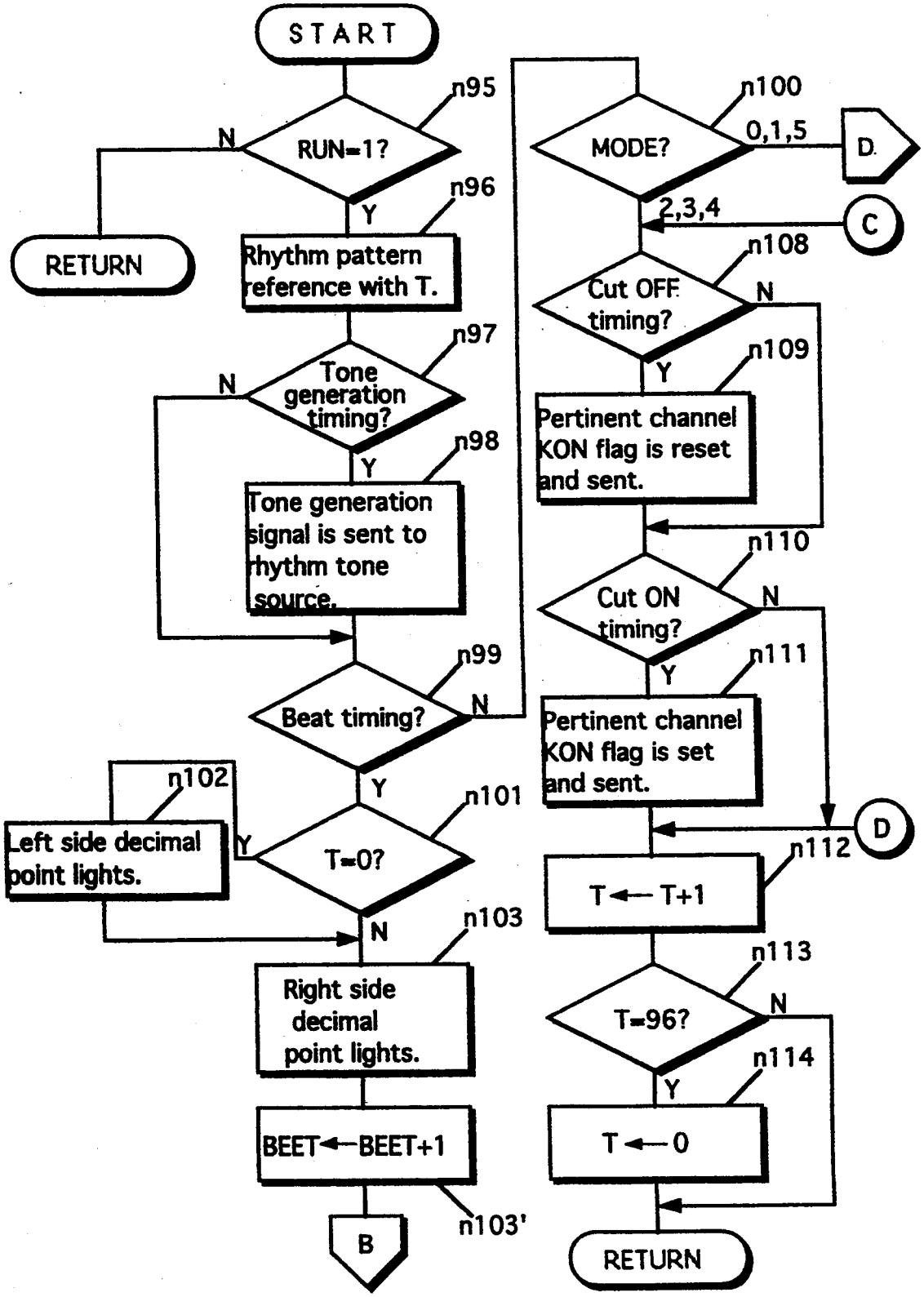
Figure 8P:
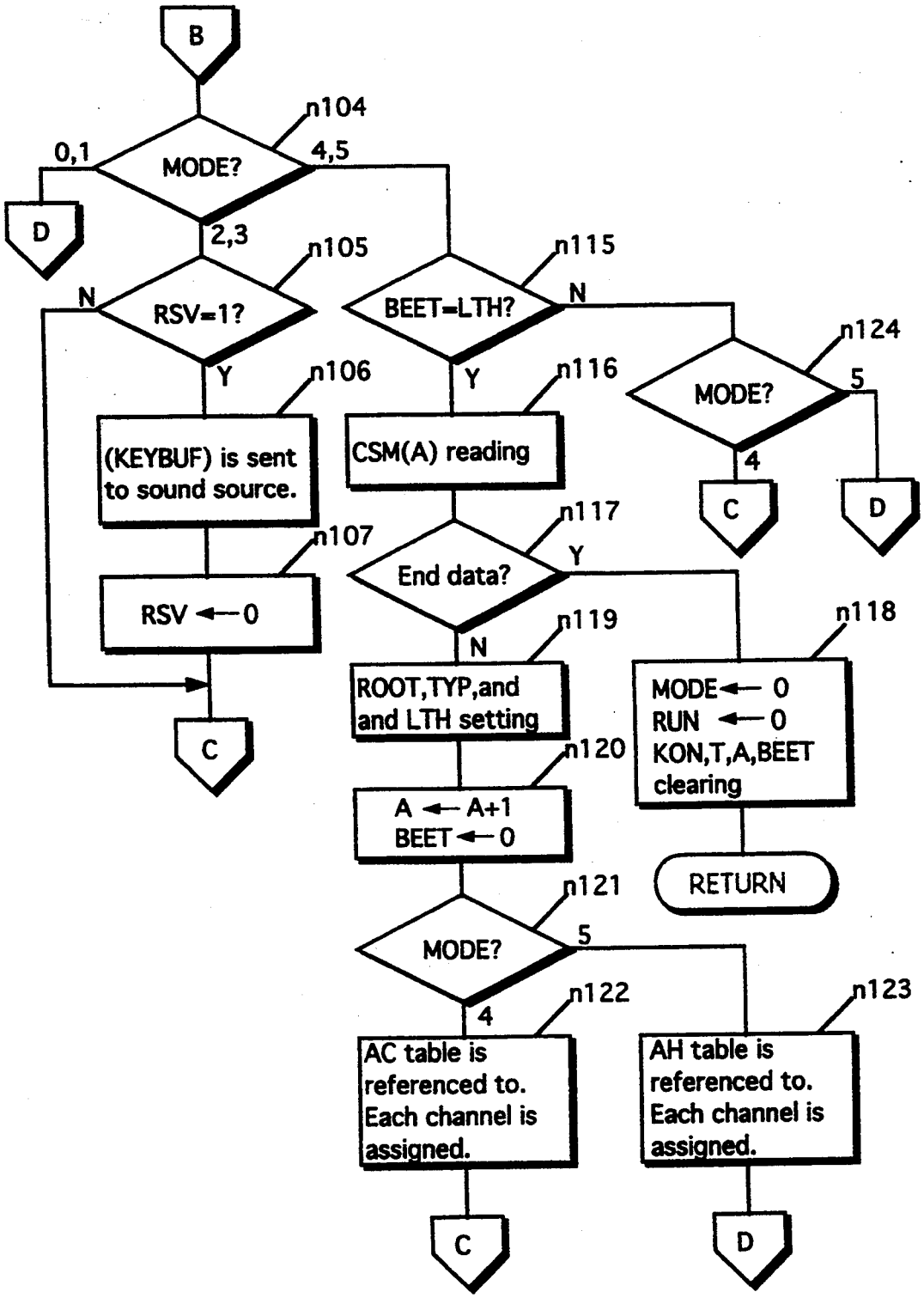
Figure 8:
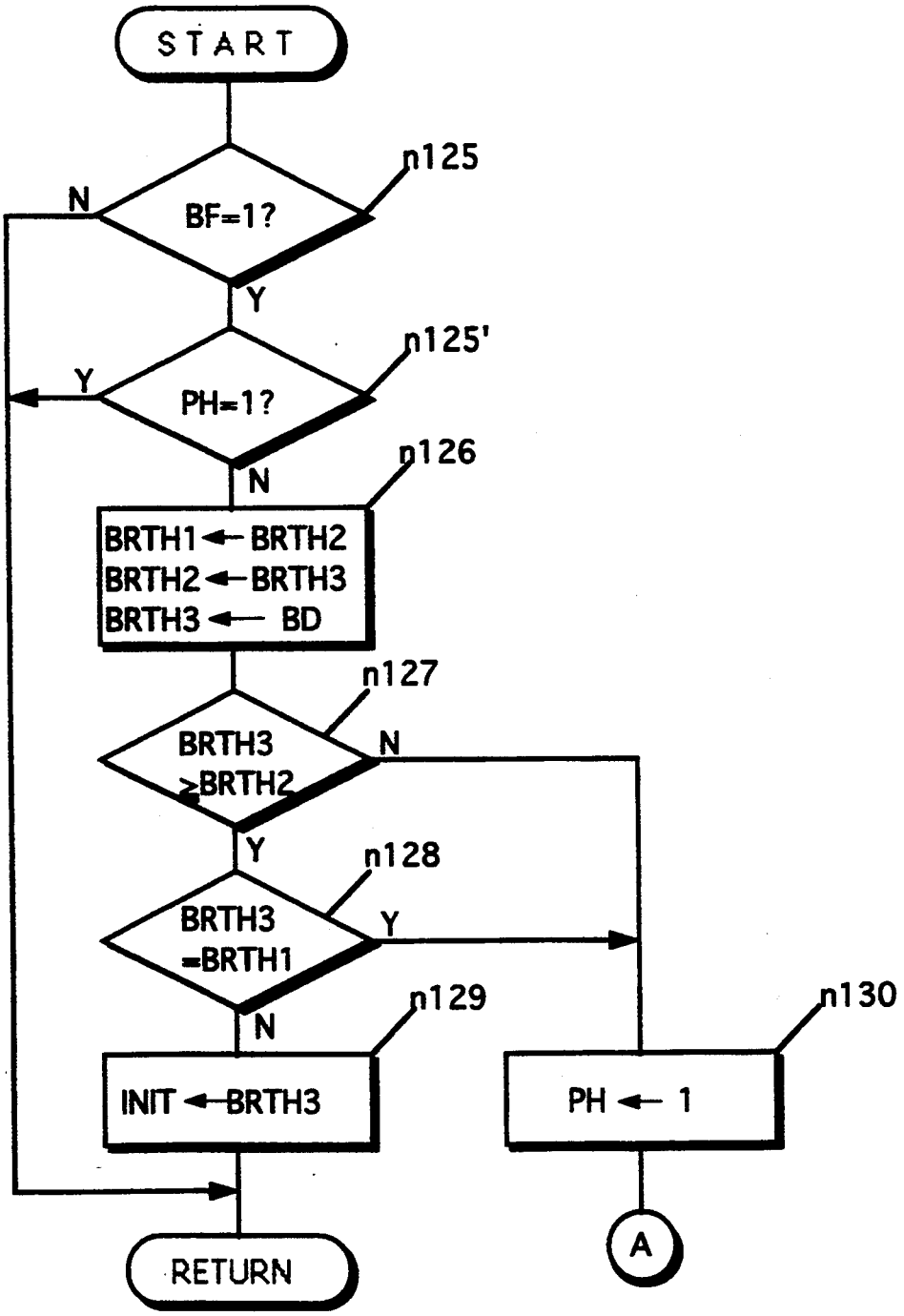
Figure 10:
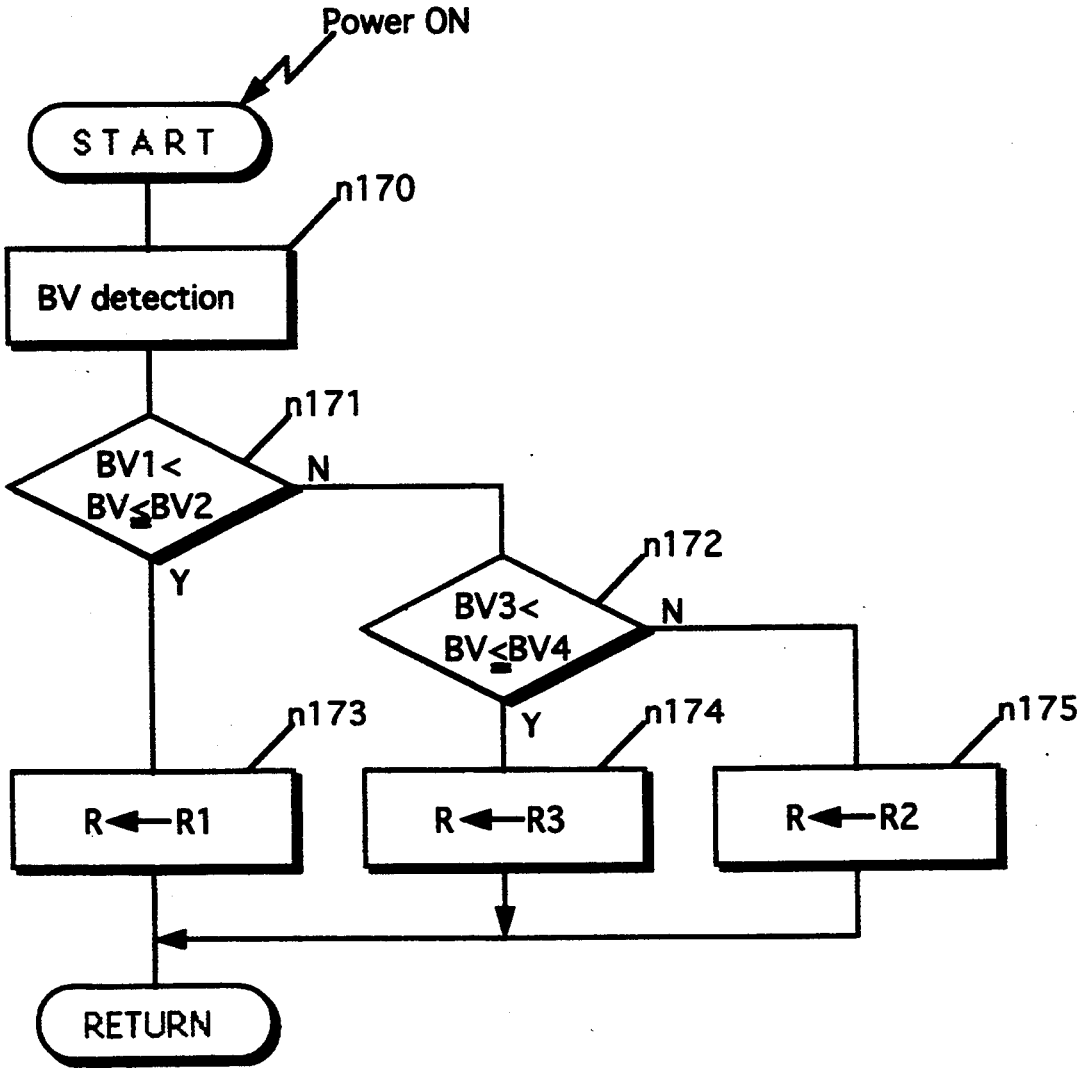
FIG. 10 and FIG. 11 show the other examples of the breath trimming operation.

FIG. 10 shows a flow chart of this system. Operation of this system is executed in place of the operation shown in Fig.8(B). In this operation, the range of BV is divided into BV1,BV2,BV3, and BV4 (where BVi<BV2<BV3<BV4), and for each of them a coefficient is specified. However, when the sensor voltage BV is lower than BV1 and when the sensor voltage BV is higher than BV4, a reference coefficient R2 is set. Accordingly, BV detected at the step n170 is judged at the step n171 and n172. If BVi>BV>BV2, R1 is set in R(n171 to n173). If BV3>BV>BV4, R3 is set in R (n172 to n174). If BViBVBV2, and BV3>BV>BV4 are not valid, BV2<BV<BV3, BV<BV1 or BV>BV4 is valid. Therefore R2 is set in R(n175), and the process returns. The above-mentioned example of embodiment and the example of embodiment which is shown in FIG. 10 relate to the system designed to calculate the breath intensity data BD by multiplying the sensor BV by the coefficient R. It is possible to apply a system featuring that the breath intensity data is obtained by adding a specific shift coefficient S to the sensor voltage (tentative breath intensity data).

Figure 11A:
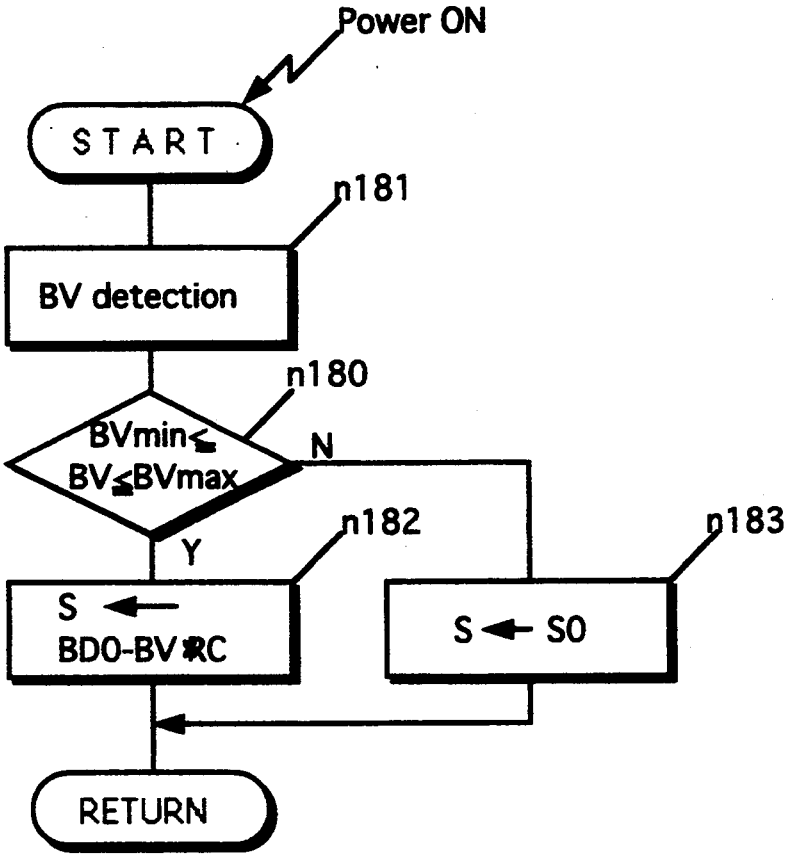
Figure 11B:
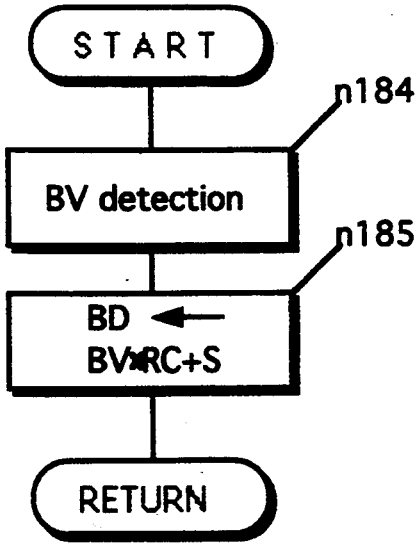

A flow chart of this system is shown in FIG. 11 (A) and (B). The system shown in FIG. 11 (A) is executed in place of the system shown in FIG. 8 (C). The system shown in FIG. 11 (B) is executed in place of the system shown in FIG. 8(C). In FIG. 11(A), when a power switch 12 is turned on, the current breath sensor voltage BV is taken in (n180), and a judgment as to whether or not BVminBVBVmax is valid (n181). If BV is within the above-mentioned range, a shift coefficient S is determined by using BDO-BV×RC (constant). If BV is not within the above-mentioned range, a preset coefficient RO is set in R (n183), and the process returns. In FIG. 11 (B), the sensor voltage BV is read in at the step n184. BV is multiplied by a coefficient Rc, and S which is determined by the above-mentioned operation is added to the product obtained by above-mentioned multiplication to determine BD(n185). Thus obtained value is stored in a breath intensity register BD.

Above are described the operations of this electronic wind instrument. As stated above, this instrument is designed so that while the initial intensity is detected, tone is generated and breath flag BF is set, the tone generation level (number of generated tones, number of parts) is maintained. It is allowed to control the tone generation level (number of generated tones, number of parts) according to varying breath intensity. Or, also in the AC mode, it is allowed to control the number of parts based on the breath intensity.

Above is the description of the preferred embodiments of the present invention. This invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein

What is claimed is:

1. An electronic musical instrument, comprising:

a plurality of keys for designating a tone pitch to be generated by a particular combination of operation states of said keys;

input means for inputting a tone generation level control data representing the level of a tone to be generated;

a plurality of sound sources which can independently generate a tone having the tone pitch designated by said particular combination; and sound source number controlling means connected to the input means for controlling the number of said sound sources of tones to be generated simultaneously according to the tone generation level control data.

2. The electronic musical instrument according to claim 1 wherein said plurality of sound sources generate tones representing shifting musical tones of the same pitch.

3. The electronic musical instrument according to claim 1 wherein said sound source controlling means increases or reduces the number of said sound sources of tones to be generated.

4. The electronic musical instrument according to claim 1 wherein tone generation ON/OFF and tone generation level of said each sound source are controlled together based on said tone generation level control data.

5. The electronic musical instrument according to claim 1 wherein said each sound source generates tone with constant level irrespective of value of said tone generation level control data in case said tone generation level control data is higher than a specified value.

6. The electronic musical instrument according to claim 1 wherein said tone generation level control data is created based on a breath intensity of breath blown into a mouthpiece.

7. An electronic musical instrument, comprising:

a plurality of keys for designating a tone pitch to be generated by a combination of operation states of said keys;

chord specifying means for specifying a chord with its root and type; and control means for controlling the number of composed tones of the specified chord to be generated simultaneously according to a tone generation level control data.

8. The electronic musical instrument according to claim 7 wherein said part number control means increases or reduces the number of composed tones of said specified chord to be generated.

9. The electronic musical instrument according to claim 7 wherein tone generation ON/OFF and tone generation level of each said composed tones are controlled based on said tone generation level control data.

10. The electronic musical instrument according to claim 7 wherein tone generation level of each said composed tones is controlled to constant level irrespective of value of said tone generation level control data in case that said tone generation level control data is higher than a specified value.

11. The electronic musical instrument according to claim 7 wherein said tone generation level control data is created based on an intensity of breath blown into a mouthpiece.

12. An electronic musical instrument, comprising:

tempo generation means for generating rhythm beats having a predetermined period;

accepting means for accepting a tone generation operation input;

detecting means for detecting a time period between first timing when said tone generation operation input is accepted and second timing when a previous beat is generated immediately before said first timing; and timing control means for controlling whether a tone is generated at said first timing or at beat timing next to said first timing based on a detection result outputted from said detecting means.

13. The electronic musical instrument according to claim 12 wherein said timing control means controls that tone is generated at once in case said delay is less than a specified value, or so that tone is generated from the next beat timing in case said delay exceeds the specified value.

14. The electronic musical instrument according to claim 12 wherein said tone generation operation accepting means for accepting a chord.

15. the electronic musical instrument according to claim 12 wherein tempo of said rhythm tempo generation means can be changed by switch operation.

16. An electronic instrument, comprising:

a sensor for detecting an operation of a control section during playing an instrument and providing an output value;

storing means for storing reference data representing tone generation level control data;

coefficient calculation means for calculating a coefficient based on the reference data and a value detected by said sensor during a specified time period; and control means for controlling said reference data based on said calculated coefficient to control tone generation level according to a relation between the value detected by said sensor and the tone generation level represented by the stored reference data.

17. The electronic musical instrument according to claim 16 wherein said sensor detects linearly said operation of control section.

18. The electronic musical instrument according to claim 16 wherein said operation is expressed as intensity of breath blown into a mouthpiece.

19. The electronic musical instrument according to claim 16 wherein said specified timing is given while power is turned on.

20. An electronic musical instrument, comprising:

a sensor for detecting an operation of control section during playing an instrument;

storing means for storing reference data, taking a reference tone generation level control data as a reference value;

coefficient calculation means for calculating and storing a coefficient to convert a value detected by said sensor obtained with a specified timing to said reference value; and converting means for converting detected values after said specified timing to a tone generation level control data, using said coefficient calculated and stored by said coefficient calculation means wherein said coefficient calculation means comprises means for calculating said coefficient from a ratio of the detected value obtained with said specified timing to said reference value; and said converting means is means for calculating said tone generation level control data by multiplying said detected values after said specified timing by said coefficient.

21. An electronic musical instrument, comprising:

a sensor for detecting an operation of control section during playing an instrument;

storing means for storing reference data, taking a reference tone generation level control data as a reference value;

coefficient calculation means for calculating and storing a coefficient to convert a value detected by said sensor obtained with a specified timing to said reference value; and converting means for converting detected values after said specified timing to a tone generation level control data, using said coefficient calculated and stored by said coefficient calculation means wherein said coefficient calculation means comprises means for calculating said coefficient from a difference between the detected value obtained at said specified timing and said reference value; and said converting means is means for calculating said tone generation level control data by multiplying said detected values after said specified timing by a constant and adding said coefficient.

22. An electronic musical instrument having a function of a chord record mode in which specified chords are recorded in storage means along with generating accompaniment tones according to the chords, and a function of a chord playback mode in which the recorded chords are played back along with generating the accompaniment tones according to the recorded chords, comprising:

chord specifying means for specifying the chord in the chord record mode;

record means for recording the chord specified by the chord specifying means into the storage means according to specified record timing;

control means for controlling chord specifying timing of the chord specified by the chord specifying means to synchronize timing with the specified record timing in case that the chord specifying timing deviates from the specified record timing in the chord record mode;

read means for reading out successively the recorded chords from the storage means in the chord playback mode; and accompaniment tone generation means for generating the accompaniment tones at the synchronized timing according to the specified chords in the chord record mode, and generating the accompaniment tones according to the chords read out from the storage means by the read means in the chord playback mode.

23. An electronic musical instrument according to claim 22, wherein said specified record timing is beat timing.

24. An electronic musical instrument, comprising:

a plurality of playing keys, each having an operation state;

means for designating a tone pitch to be generated in accordance with a combination of the operation states of a plurality of the keys;

root specifying means for accepting specification of a root of a chord to be generated by a combination of the operation states of the plurality of the keys;

type specifying means for accepting a type of said chord to be generated by keys other than said playing keys; and chord generation means for generating said chord to be generated.

25. An electronic musical instrument, comprising:

a plurality of playing keys;

single tone specifying means for accepting specification of one pitch according to a fingering pattern for the plurality of playing keys;

chord specifying means for accepting specification of one chord according to said fingering pattern for the plurality of playing keys; and selecting means for selecting either said single tone specifying means or said chord specifying means.

26. An electronic musical instrument, comprising:

a plurality of playing keys for designating a tone pitch to be generated by a combination of operation states of a plurality of keys;

root specifying means for accepting specification of a root of a chord to be generated by a combination of operation states of the plurality of keys;

type specifying means for accepting a type of said chord to be generated by keys other than said playing keys; and chord generation means for generating said chord to be generated;

key arrangement of said plurality of playing keys being similar to that of woodwind instruments, said type of chord being specified by at least one key operated by a left hand thumb of a player, and other keys being used to specify said root of said chord to be generated.

* * * * *